US008776277B2

(12) United States Patent
Leo

(10) Patent No.: US 8,776,277 B2
(45) Date of Patent: Jul. 15, 2014

(54) LAVATORY DISPENSING DEVICE

(75) Inventor: Hui-Lian Leo, Singapore (SG)

(73) Assignee: Reckitt Benckiser LLC, Parsippany, NJ (US)

( * ) Notice: Subject to any disclaimer, the term of this patent is extended or adjusted under 35 U.S.C. 154(b) by 446 days.

(21) Appl. No.: 13/121,302

(22) PCT Filed: Aug. 3, 2009

(86) PCT No.: PCT/GB2009/001896

§ 371 (c)(1),
(2), (4) Date: Mar. 28, 2011

(87) PCT Pub. No.: WO2010/037997

PCT Pub. Date: Apr. 8, 2010

(65) Prior Publication Data

US 2011/0173742 A1 Jul. 21, 2011

(30) Foreign Application Priority Data

Oct. 1, 2008 (GB) ..... 0817944.2

(51) Int. Cl.
*E03D 9/02* (2006.01)

(52) U.S. Cl.
USPC ..... 4/223; 4/231

(58) Field of Classification Search
USPC ..... 4/231, 630, 222, 222.1, 223, 224, 4/227.6, 227.5, 232
See application file for complete search history.

(56) References Cited

U.S. PATENT DOCUMENTS

| | | | | |
|---|---|---|---|---|
| 2,760,209 | A | 8/1956 | Ewing et al. | |
| 4,180,875 | A | 1/1980 | Wilson | |
| 7,013,498 | B1 * | 3/2006 | Smith et al. | 4/231 |
| 7,832,025 | B2 * | 11/2010 | Virica et al. | 4/227.4 |
| 7,979,923 | B2 * | 7/2011 | Hsu | 4/309 |
| 2007/0214555 | A1 | 9/2007 | Ferrara et al. | |
| 2007/0240252 | A1 | 10/2007 | Leonard et al. | |

FOREIGN PATENT DOCUMENTS

| | | | |
|---|---|---|---|
| GB | 21166 | A | 0/1913 |
| JP | 2005344347 | A * | 12/2005 |

OTHER PUBLICATIONS

English Machine translation of JP 2005344347A.*

* cited by examiner

*Primary Examiner* — Gregory Huson
*Assistant Examiner* — Christine Skubinna
(74) *Attorney, Agent, or Firm* — Norris McLaughlin & Marcus PA

(57) ABSTRACT

The present invention relates to improved toilet dispensing devices for use in conjunction with a sanitary appliance, particularly a toilet.

14 Claims, 4 Drawing Sheets

LAVATORY DISPENSING DEVICE

Figure 1:
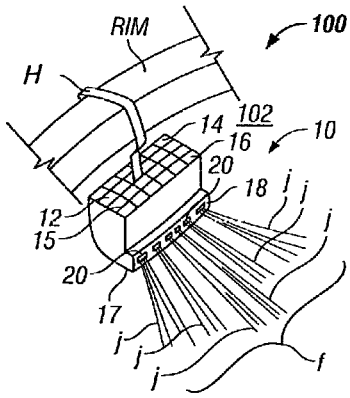

This is an application filed under 35 USC 371 of PCT/GB2009/001896.

The present invention relates to improved lavatory dispensing devices. More particularly the present invention relates to improved lavatory dispensing devices which are useful in conjunction with a toilet cistern, as well as a method for delivering a treatment composition to a toilet bowl in toilets provided with a cistern. The said treatment composition contains one or more chemical constituents e.g., coloring agents, cleaning agents, disinfecting agents, anti-lime scale agents which are provided with the dispensing devices. The treatment composition is formed by water contacting the chemical constituents of the device coming into contact with the one or more chemical constituents, which are released into the bowl of the toilet.

Since the advent of sanitary appliances and in particular modern flush toilets, there has been a continuing need in the art to provide effective ways to maintain these appliances in a satisfactory condition between uses. The art is replete with devices which are intended to be used as "in the bowl" (or ITB) or "in the cistern" (or ITC) in order to provide a coloring and/or cleaning and/or fragrancing and/or sanitizing effect to such sanitary devices, particularly toilet bowls.

Widely known in the relevant art are ITB type devices which are adapted to be suspended from a part of the rim of a lavatory appliance, particularly a toilet bowl. One such type of ITB type devices are those which include a container such as a perforated housing or a cage which contains within its interior and a quantity of a treatment composition typically in the form of a block, tablet or take. The container is suspended due within the interior of the toilet bowl and ideally within the direction of the path of flushing water which is periodically released by the device and such water enters the container, comes into contact with the treatment composition and dissolves at least a part of the same, or otherwise entrains a part of the same, and thus forms a lavatory treatment composition which thereafter exits the container and enters into the toilet bowl. Such an ITB type typically only provides for localized treatment of a part of the toilet bowl as typically, the lavatory treatment composition formed does not usually pass to the opposite side of the interior of a toilet bowl. Additionally, a further shortcoming of such prior art ITB type devices are that, while surfactants are frequently included as part of the treatment composition, the poor fluid dynamics of the flush water quickly transiting through the interior of the container typically provides for little turbulence to be imparted to this flowing lavatory treatment composition and thus, poor air entrainment and minimal formation of a visible foam or bubbles frequently occurs. Such is undesirable from a consumer standpoint. Thus, such prior art ITB type devices do provide certain advantages however, their use is not without significant technical shortcomings. It is to these foregoing technical shortcomings, as well as to further technical advantages, that the present invention is directed.

The present invention, in its various aspects, provides an ITB type lavatory dispensing device useful for the delivery of at least one treatment composition, preferably a cleaning composition and/or a sanitizing composition to a sanitary appliance, e.g. a toilet bowl.

According to a first aspect of the invention there is provided an improved lavatory dispensing device comprising a treatment composition adapted to be mounted on part of the rim of a lavatory appliance, as especially part of the rim of a toilet bowl, which device provides improved fluid transport of the lavatory treatment composition formed therein and improved directional dispersal of said lavatory treatment composition within the interior of the toilet bowl. In preferred embodiments, the lavatory dispensing includes a spray means which provides one or more jets of the lavatory treatment composition which are directionally sprayed across the interior volume of the toilet bowl and in the direction of an opposing sidewall of the lavatory appliance.

In a second aspect of the invention there is provided a process for treating a lavatory appliance, especially a toilet, with the improved lavatory dispensing device described herein.

In a third aspect there is provided a method for the manufacture of the improved lavatory dispensing devices described herein.

These and other aspects of the invention will be more evident from a reading of the following specification.

Broadly defined, the present invention provides an improved lavatory dispensing device comprising a treatment composition adapted to be mounted on part of the rim of a lavatory appliance, as especially part of the rim of a toilet bowl, which device provides improved fluid transport of the lavatory treatment composition formed therein and improved directional dispersal of said lavatory treatment composition within the interior of the lavatory appliance, especially a toilet bowl. The said lavatory dispensing device is in the form of an ITB type device, that is to say that it typically configured and typically adapted to be suspended from a part of a lavatory appliance, such at the rim of a toilet bowl, such that a portion of the device is suspended within the interior of the lavatory appliance, such as a toilet bowl. Thus, the lavatory dispensing device may include a hanger means which is used to positionally suspend the device upon a part of the lavatory appliance, and further includes a container which includes an inlet in fluid communication with an internal cavity, which is in turn in fluid communication with a spray means which provides means for providing one or more jets of a lavatory treatment composition to be directionally sprayed across the interior volume of the toilet bowl, typically in the direction of an opposing side wall of the lavatory appliance. The spray means concurrently provides the outlet(s) for the device. Such jets of a lavatory treatment composition are formed by providing within the interior of the container a treatment composition which it is positioned intermediate the inlet and the spray means such that any water, such as flush water, released from the lavatory appliance enters downwardly in through the inlet of the said device, where it comes into contact with the treatment composition which may be provided as a tablet, cake, block, or gel, and wherein said water entrains and/or dissolves a portion of the treatment composition and thereby forms the lavatory treatment composition which is essentially a largely aqueous lavatory treatment composition which then exits the device at least partially but preferably substantially through the spray means, such that the lavatory treatment composition is sprayed preferably in one or more streams or "jets", transversely across the interior of the lavatory appliance, preferably across the interior of a toilet bowl.

Optionally but preferably, the device may include a support means intermediate the inlet and the spray means out of the device which support means is used to provide a physical platform for the retention of the treatment composition; such may take the form of a screen or a grill with spaced apart bars. Further optionally but preferably, the device may also include an inlet retainer means, typically in the form of a screen or grill with spaced-apart bars, which inlet retainer means it is advantageously positioned in the proximity of the inlet and is adapted to retain the treatment composition within the interior of the container. In certain preferred embodiments both a support means, and an inlet retainer means are concurrently present and are used to retain the treatment composition therebetween. One or more of the above are advantageously provided to ensure that the treatment composition present within the interior of the device does not prematurely exit the device, that is to say either exiting via the inlet, or via the spray means. In preferred modes of operation, the treatment composition slowly erodes and/or dissolves via the action of the sequential periodic passing of flush water through the device.

In preferred embodiments, the spray means of the lavatory dispensing device provides one or more jets of the aqueous lavatory treatment composition which jets are used to define a plurality of individual fluid streams which are directionally sprayed across the interior volume of the toilet bowl and in the direction of an opposing side wall relative to the positioning of the device mounted in the interior of the lavatory appliance.

Several advantages follow from the use of the device according to the present invention. First, the device which includes the spray means which delivers one or more jets of the aqueous lavatory treatment composition across the interior volume of the toilet bowl ensures that an improved distribution of the lavatory treatment composition occurs. Such is typically not the case with most prior art ITB-type devices which typically only provide a localized delivery of the aqueous lavatory treatment composition, typically at or near the location of the mounted ITB-type device. Such is especially the case for European type toilets where, they flush water is provided to the interior of the toilet bowl in a manner such that it generally flows substantially directly downward from beneath the rim and towards the bottom or "sump" of the bowl. This is in contrast to most North American type toilet bowls which typically operates such that a swirling effect is imparted to the water exiting from beneath the rim of such a toilet bowl such that a volume of flush water thus dispensed swirls at least partially helically downwardly towards the sump of the toilet bowl. However, even such a swirling effect is frequently inadequate to deliver a good foaming in appearance to the aqueous lavatory treatment composition being formed by the flush water passing through the interior of the container of the ITB. This is due to the fact that this little air entrainment occurs in the aqueous lavatory treatment composition being delivered in exiting the ITB type device. The use of the improved lavatory dispensing device as described herein, overcomes these technical shortcomings as the aqueous lavatory treatment composition being formed within the said device, in exiting via the spray means is directed, preferably jetted, across a part of the toilet bowl and in the direction of the side wall opposite to that part of the side wall nearest to which the ITB type device of the invention is positioned. The spray means provides for improved air entrainment within the aqueous lavatory treatment composition, which thus provides an improved foaming appearance particularly wherein the treatment composition within the device includes one or more surfactants. Additionally, the spray means provides for the transport of the largely aqueous lavatory treatment composition to other regions within the interior of the toilet bowl, and not merely in the general locus of the toilet bowl, namely substantially beneath the position of the ITB type device of the invention mounted upon a portion of the toilet bowl. Such is a particularly important feature when the ITB type device of the invention is mounted upon a European type toilet which typically does not provide swirling effects which would otherwise improve the dispersion with delivery of the aqueous lavatory treatment composition to other parts of the interior of the toilet bowl.

In certain and preferred embodiments of the lavatory dispensing device of the invention, in addition to one or more outlets, the spray means includes one or more flow directing vanes within the interior of the container which said vanes function to divide the volume of the aqueous lavatory treatment composition downstream of the treatment composition and direct these separate volumes of the aqueous lavatory treatment compositions to individual outlets, wherein the aqueous lavatory treatment composition exits the device preferably in the form of jets. In preferred embodiments, the outlets are non-collinear with the inlet, more preferably, the exit direction of the outlets are directed at an angle of between 45° and 135°, preferably between 60° and 120°, yet more preferably between 75° and 105°, and especially preferably are about 90° with respect to the central axis of the device. The central axis of the device may be conveniently established by determining the line segment which passes substantially perpendicularly through a plane defined by one of: a plane traversing the top of the device, and/or the a plane traversing the inlet of the device, and/or a plane coincident with the midsection of the support means. Alternately, the exit direction of the outlets may also be measured with respect to and with reference to the rim of the lavatory appliance, especially a toilet bowl, upon which the device according the invention is mounted. Accordingly the outlets are non-collinear with said rim, more preferably, the exit direction of the outlet are directed at an angle of between 45° and 135°, preferably between 60° and 120°, yet more preferably between 75° and 105°, and especially preferably are about 90° with respect to the a plane defined by the top of the rim of a lavatory appliance upon which the device is mounted.

As should be appreciated from the foregoing, and as will be better understood with regard to a review of one or more of the figures, unlike many prior art to ITB-type devices which allow for flush water to pass through said devices but did not substantially alter or divert the direction of the liquid exiting the device, the improved lavatory treatment devices of the invention provides for a significant redirection or deflection of the lavatory treatment composition and exiting the device as compared to many prior art ITB type devices. According to preferred embodiments of the invention, the improved lavatory dispensing device of the invention is configured such that, when it is mounted upon the rim of a toilet bowl such that the inlet is within the path of flush water are being released by the lavatory appliance, the water exiting the device, or namely now the aqueous lavatory treatment composition exiting the device exits as one or more liquid streams which "leap" across a part of the toilet bowl. In preferred embodiments, a plurality of such liquid streams are present and, which may form a generally horizontal, fan-like pattern of individual streams of the equally as lavatory treatment composition which "leap" or are jetted across a part of the toilet bowl. The provision of such a fan-like pattern of individual streams concurrently provides for improved coverage of the aqueous lavatory treatment composition being delivered by the device, and concurrently may provide for a substantially improve its perceived foaming benefits particularly wherein the treatment composition within the interior of the device includes one or more foaming type materials, generally one or more surfactants. Desirably, the breadth of the fan-like pattern of individual streams concurrently exiting the device of the invention is a least 15°, more preferably at least 25°, still more preferably at least 30°, as is illustrated in one or more of the following figures.

In further embodiments of the invention, the device may contain two or more different treatment compositions having different chemistries contained therein. In such embodiments, the interior of the device may be divided by one or more vertical walls or other dividing means which divides at least a portion of the interior of the lavatory dispensing device into two or more parts. Such an interior arrangement permits for the use of two dissimilar treatment compositions within the device, i.e., those which may be chemically incompatible with one another. Such an embodiment may be particularly advantageously used wherein is desire to form a lavatory treatment composition from a first part and the second part, which are namely a first lavatory treatment composition and a second lavatory treatment composition which react or interact to provide a technical benefit, such as a visual benefit such as effervescence, foaming, a color change, and the like only upon the mixing of the first part, or more specifically a first composition formed by contacting water with a first treatment composition, and the second part, or more specifically a second composition formed by contacting water with a second treatment composition which are present, but separated from one another, within the hollow cavity of the lavatory dispensing device.

The lavatory dispensing device may be of a single unitary piece but typically is expected to be assembled from a plurality of discrete pieces or elements may be formed from any of a variety of materials which can be used for the purpose described herein. Exemplary and preferred materials include metals such as coated papers which are at least for a time essentially impervious to water, metal sheets or metal foils, non-metallic materials any of a number of thermosettable or thermoformable synthetic polymers such as are widely used in casting or injection molding. Exemplary synthetic polymers such as polyamides, polyolefins (e.g., polypropylene, polyethylene) as well as polyalkyleneterephalates (i.e., polyethylene terephthalate, polybutylene terephthalate), polystyrenes, polysulfones, polycarbonates as well as copolymers formed from monomers of one or more of the foregoing being several nonlimiting examples of useful synthetic polymers.

The dispensing devices according to the invention necessarily also comprise at least one treatment composition comprising at least one or more chemical constituents such that when the treatment composition is rinsed or washed with water, one or more chemical compounds or chemical constituents are dissolved or eluted therefrom and dispersed or dissolved into said water and thereby forms a largely aqueous, lavatory treatment composition which is useful in treating a sanitary appliance, particularly a toilet bowl. The lavatory treatment composition advantageously provides a cleaning and/or sanitizing benefit to the treated sanitary appliance.

The treatment composition of the invention may include any known art cleaning agents or cleaning constituents known to those of ordinary skill in the relevant art, and without limitation include one or more detersive surfactants selected from anionic, cationic, nonionic as well as amphoteric or zwitterionic surfactants. Certain detersive surfactants may also provide a dual role in providing detergency as well as a disinfecting effect, viz, certain cationic surfactants, which are described hereinafter as a disinfecting agent. These one or more cleaning agents or cleaning constituents may be used with or without other constituents being present in the treatment compositions of the invention.

In certain embodiments, the treatment composition of the invention desirably comprises a surfactant constituent which may be one or more detersive surfactants.

Exemplary useful anionic surfactants which may be used in the treatment composition of the invention can be broadly described as the water-soluble salts, particularly the alkali metal salts, of organic sulfuric acid reaction products having in their molecular structure an alkyl or alkaryl radical containing from about 8 to about 22 carbon atoms and a radical selected from the group consisting of sulfonic acid and sulfuric acid ester radicals. (Included in the term alkyl is the alkyl portion of higher acyl radicals.) Important examples of the anionic surfactants which can be employed in practicing the present invention are the sodium or potassium alkyl sulfates, especially those obtained by sulfating the higher alcohols ($C_8$-$C_{18}$ carbon atoms) produced by reducing the glycerides of tallow or coconut oil; sodium or potassium alkyl benzene sulfonates, in which the alkyl group contains from about 9 to about 15 carbon atoms, (the alkyl radical can be a straight or branched aliphatic chain); paraffin sulfonate surfactants having the general formula $RSO_3$ M, wherein R is a primary or secondary alkyl group containing from about 8 to about 22 carbon atoms (preferably 10 to 18 carbon atoms) and M is an alkali metal, e.g., sodium, lithium or potassium; sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid esters of the reaction product of one mole of a higher fatty alcohol (e.g., tallow or coconut oil alcohols) and about 1 to 10 moles of ethylene oxide; sodium or potassium salts of alkyl phenol ethylene oxide ether sulfates with about 1 to about 10 units of ethylene oxide per molecule and in which the alkyl radicals contain from about 8 to about 12 carbon atoms; the reaction products of fatty acids esterified with isethionic acid and neutralized with sodium hydroxide where, for example, the fatty acids are derived from coconut oil; sodium or potassium salts of fatty acid amides of a methyl tauride in which the fatty acids, for example, are derived from coconut oil and sodium or potassium β-acetoxy- or β-acetamido-alkanesulfonates where the alkane has from 8 to 22 carbon atoms.

Further examples of useful anionic surfactants are alpha olefin sulfonates, as well as salts thereof, e.g., alkali metal salts. Preferred are $C_8$ through $C_{22}$ alpha olefin sulfonates, particularly $C_{12}$ through $C_{18}$, and especially $C_{14}$, and $C_{16}$ alpha olefin sulfonates as well as blends of two or more thereof.

The detersive surfactant constituent of the treatment composition of the invention may include one or more nonionic surfactants. Practically any hydrophobic compound having a carboxy, amido, or amino group with a free hydrogen attached to the nitrogen can be condensed with an alkylene oxide, especially ethylene oxide or with the polyhydration product thereof, a polyalkylene glycol, especially polyethylene glycol, to form a water soluble or water dispersible nonionic surfactant compound. Further, the length of the polyethenoxy hydrophobic and hydrophilic elements may various. Exemplary nonionic compounds include the polyoxyethylene ethers of alkyl aromatic compounds, e.g., alkylated polyoxyethylene phenols, polyoxyethylene ethers of long chain aliphatic alcohols, the polyoxyethylene ethers of hydrophobic propylene oxide polymers, and the higher alkyl amine oxides.

One class of useful nonionic surfactants include polyalkylene oxide condensates of alkyl phenols. These compounds include the condensation products of alkyl phenols having an alkyl group containing from about 6 to 12 carbon atoms in either a straight chain or branched chain configuration with an alkylene oxide, especially an ethylene oxide, the ethylene oxide being present in an amount equal to 5 to 25 moles of ethylene oxide per mole of alkyl phenol. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol and diisooctyl phenol condensed with about 15 moles of ethylene oxide per mole of phenol.

A further class of useful nonionic surfactants include the condensation products of aliphatic alcohols with from about 1 to about 60 moles of an alkylene oxide, especially an ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol and the condensation product of about 9 moles of ethylene oxide with coconut alcohol (a mixture of fatty alcohols with alkyl chains varying in length from about 10 to 14 carbon atoms). Other examples are those $C_6$-$C_{11}$ straight-chain alcohols which are ethoxylated with from about 3 to about 6 moles of ethylene oxide. Their derivation is well known in the art. Examples include Alfonic® 810-4.5, which is described in product literature from Sasol as a $C_8$-$C_{10}$ straight-chain alcohol having an average molecular weight of 356, an ethylene oxide content of about 4.85 moles (about 60 wt. %), and an HLB of about 12; Alfonic® 810-2, which is described in product literature as a $C_8$-$C_{10}$ straight-chain alcohols having an average molecular weight of 242, an ethylene oxide content of about 2.1 moles (about 40 wt. %), and an HLB of about 12; and Alfonic® 610-3.5, which is described in product literature as having an average molecular weight of 276, an ethylene oxide content of about 3.1 moles (about 50 wt. %), and an HLB of 10. Other examples of alcohol ethoxylates are $C_{10}$ oxo-alcohol ethoxylates available from BASF under the Lutensol® ON tradename. They are available in grades containing from about 3 to about 11 moles of ethylene oxide (available under the names Lutensol® ON 30; Lutensol® ON 50; Lutensol® ON 60; Lutensol® ON 65; Lutensol® ON 66; Lutensol® ON 70; Lutensol® ON 80; and Lutensol®ON 110). Other examples of ethoxylated alcohols include the Neodol® 91 series non-ionic surfactants available from Shell Chemical Company which are described as $C_9$-$C_{11}$ ethoxylated alcohols. The Neodol® 91 series non-ionic surfactants of interest include Neodol® 91-2.5, Neodol® 91-6, and Neodol® 91-8. Neodol® 91-2.5 has been described as having about 2.5 ethoxy groups per molecule; Neodol 91-6 has been described as having about 6 ethoxy groups per molecule; and Neodol 91-8 has been described as having about 8 ethoxy groups per molecule. Further examples of ethoxylated alcohols include the Rhodasurf® DA series non-ionic surfactants available from Rhodia which are described to be branched isodecyl alcohol ethoxylates. Rhodasurf® DA-530 has been described as having 4 moles of ethoxylation and an HLB of 10.5; Rhodasurf® DA-630 has been described as having 6 moles of ethoxylation with an HLB of 12.5; and Rhodasurf® DA-639 is a 90% solution of DA-630. Further examples of ethoxylated alcohols include those from Tomah Products (Milton, Wis.) under the Tomadol® tradename with the formula $RO(CH_2CH_2O)_nH$ where R is the primary linear alcohol and n is the total number of moles of ethylene oxide. The ethoxylated alcohol series from Tomah include 91-2.5; 91-6; 91-8—where R is linear $C_9/C_{10}/C_{11}$ and n is 2.5, 6, or 8; 1-3; 1-5; 1-7; 1-73B; 1-9; where R is linear $C_{11}$ and n is 3, 5, 7 or 9; 23-1; 23-3; 23-5; 23-6.5—where R is linear $C_{12}/C_{13}$ and n is 1, 3, 5, or 6.5; 25-3; 25-7; 25-9; 25-12—where R is linear $C_{12}/C_{13}/C_{14}/C_{15}$ and n is 3, 7, 9, or 12; and 45-7; 45-13—where R is linear $C_{14}/C_{15}$ and n is 7 or 13.

A further class of useful nonionic surfactants include primary and secondary linear and branched alcohol ethoxylates, such as those based on $C_6$-$C_{18}$ alcohols which further include an average of from 2 to 80 moles of ethoxylation per mol of alcohol. These examples include the Genapol® UD (ex. Clariant, Muttenz, Switzerland) described under the tradenames Genapol® UD 030, $C_{11}$-oxo-alcohol polyglycol ether with 3 EO; Genapol® UD, 050 $C_{11}$-oxo-alcohol polyglycol ether with 5 EO; Genapol® UD 070, $C_{11}$-oxo-alcohol polyglycol ether with 7 EO; Genapol® UD 080, $C_{11}$-oxo-alcohol polyglycol ether with 8 EO; Genapol® UD 088, $C_{11}$-oxo-alcohol polyglycol ether with 8 EO; and Genapol® UD 110, $C_{11}$-oxo-alcohol polyglycol ether with 11 EO.

Exemplary useful nonionic surfactants include the condensation products of a secondary aliphatic alcohols containing 8 to 18 carbon atoms in a straight or branched chain configuration condensed with 5 to 30 moles of ethylene oxide. Examples of commercially available nonionic detergents of the foregoing type are those presently commercially available under the trade name of Tergitol® such as Tergitol 15-S-12 which is described as being $C_{11}$-$C_{15}$ secondary alkanol condensed with 9 ethylene oxide units, or Tergitol 15-S-9 which is described as being $C_{11}$-$C_{15}$ secondary alkanol condensed with 12 ethylene oxide units per molecule.

A further class of useful nonionic surfactants include those surfactants having a formula:

$$RO(CH_2CH_2O)_nH$$

wherein;

R is a mixture of linear, even carbon-number hydrocarbon chains ranging from $C_{12}H_{25}$ to $C_{16}H_{33}$ and n represents the number of ethoxy repeating units and is a number of from about 1 to about 12.

Surfactants of this formula are presently marketed under the Genapol® tradename (ex. Clariant), which surfactants include the "26-L" series of the general formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from 1 to about 12, such as 26-L-1, 26-L-1.6, 26-L-2, 26-L-3, 26-L-5, 26-L-45, 26-L-50, 26-L-60, 26-L-60N, 26-L-75, 26-L-80, 26-L-98N, and the 24-L series, derived from synthetic sources and typically contain about 55% $C_{12}$ and 45% $C_{14}$ alcohols, such as 24-L-3, 24-L-45, 24-L-50, 24-L-60, 24-L-60N, 24-L-75, 24-L-92, and 24-L-98N, all sold under the Genapol® tradename.

Further useful non-ionic surfactants which may be used in the treatment compositions include those presently marketed under the trade name Pluronics® (ex. BASF). The compounds are formed by condensing ethylene oxide with a hydrophobic base formed by the condensation of propylene oxide with propylene glycol. The molecular weight of the hydrophobic portion of the molecule is of the order of 950 to 4,000 and preferably 200 to 2,500. The addition of polyoxyethylene radicals of the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants are in liquid form and particularly satisfactory surfactants are available as those marketed as Pluronics® L62 and Pluronics® L64.

Further nonionic surfactants which may be included in the inventive compositions include alkoxylated alkanolamides, preferably $C_8$-$C_{24}$ alkyl di($C_2$-$C_3$ alkanol amides), as represented by the following formula:

$$R_5—CO—NH—R_6—OH$$

wherein $R_5$ is a branched or straight chain $C_8$-$C_{24}$ alkyl radical, preferably a $C_{10}$-$C_{16}$ alkyl radical and more preferably a $C_{12}$-$C_{14}$ alkyl radical, and $R_6$ is a $C_1$-$C_4$ alkyl radical, preferably an ethyl radical.

According to certain particularly preferred embodiments the detersive surfactant constituent necessarily comprises a nonionic surfactant based on a linear primary alcohol particularly wherein the alkyl portion is a $C_8$ to $C_{16}$, but particularly a $C_9$ to $C_{11}$ alkyl group, and having an average of between about 6 to about 8 moles of ethoxylation.

One further useful class of nonionic surfactants include those in which the major portion of the molecule is made up of block polymeric $C_2$-$C_4$ alkylene oxides, with alkylene oxide blocks containing $C_3$ to $C_4$ alkylene oxides. Such nonionic surfactants, while preferably built up from an alkylene oxide chain starting group, can have as a starting nucleus almost any active hydrogen containing group including, without limitation, amides, phenols, and secondary alcohols.

One group of nonionic surfactants containing the characteristic alkylene oxide blocks are those which may be generally represented by the formula (A):

$$HO—(EO)_x(PO)_y(EO)_z—H \quad (A)$$

where EO represents ethylene oxide,

PO represents propylene oxide, y equals at least 15, $(EO)_{x+z}$ equals 20 to 50% of the total weight of said compounds, and, the total molecular weight is preferably in the range of about 2000 to 15,000.

Another group of nonionic surfactants appropriate for use in the new compositions can be represented by the formula (B):

$$R—(EO,PO)_a(EO,PO)_b—H \quad (B)$$

wherein R is an alkyl, aryl or aralkyl group, the alkoxy group contains 1 to 20 carbon atoms, the weight percent of EO is within the range of 0 to 45% in one of the blocks a, b, and within the range of 60 to 100% in the other of the blocks a, b, and the total number of moles of combined EO and PO is in the range of 6 to 125 moles, with 1 to 50 moles in the PO rich block and 5 to 100 moles in the EO rich block.

Further nonionic surfactants which in general are encompassed by Formula B include butoxy derivatives of propylene oxide/ethylene oxide block polymers having molecular weights within the range of about 2000-5000.

Still further useful nonionic surfactants containing polymeric butoxy (BO) groups can be represented by formula I as follows:

$$RO—(BO)_n(EO)_x—H \quad (C)$$

wherein R is an alkyl group containing 1 to 20 carbon atoms, n is about 15 and x is about 15.

Also useful as the nonionic block copolymer surfactants which also include polymeric butoxy groups are those which may be represented by the following formula (D):

$$HO—(EO)_x(BO)_n(EO)_y—H \quad (D)$$

wherein n is about 15, x is about 15 and y is about 15.

Still further useful nonionic block copolymer surfactants include ethoxylated derivatives of propoxylated ethylene diamine, which may be represented by the following formula:

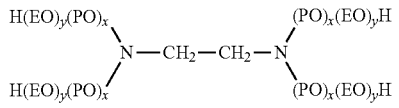

(E)

where (EO) represents ethoxy, (PO) represents propoxy, the amount of $(PO)_x$ is such as to provide a molecular weight prior to ethoxylation of about 300 to 7500, and the amount of $(EO)_y$ is such as to provide about 20% to 90% of the total weight of said compound.

Further useful nonionic surfactants include nonionic amine oxide constituent. Exemplary amine oxides include:

A) Alkyl di (lower alkyl) amine oxides in which the alkyl group has about 10-20, and preferably 12-16 carbon atoms, and can be straight or branched chain, saturated or unsaturated. The lower alkyl groups include between 1 and 7 carbon atoms.

Examples include lauryl dimethyl amine oxide, myristyl dimethyl amine oxide, and those in which the alkyl group is a mixture of different amine oxide, dimethyl cocoamine oxide, dimethyl (hydrogenated tallow) amine oxide, and myristyl/palmityl dimethyl amine oxide;

B) Alkyl di (ehydrat lower alkyl) amine oxides in which the alkyl group has about 10-20, and preferably 12-16 carbon atoms, and can be straight or branched chain, saturated or unsaturated. Examples are bis(2-hydroxyethyl) cocoamine oxide, bis(2-hydroxyethyl) tallowamine oxide; and bis(2-hydroxyethyl) stearylamine oxide;

C) Alkylamidopropyl di(lower alkyl) amine oxides in which the alkyl group has about 10-20, and preferably 12-16 carbon atoms, and can be straight or branched chain, saturated or unsaturated. Examples are cocoamidopropyl dimethyl amine oxide and tallowamidopropyl dimethyl amine oxide; and D) Alkylmorpholine oxides in which the alkyl group has about 10-20, and preferably 12-16 carbon atoms, and can be straight or branched chain, saturated or unsaturated.

Preferably the amine oxide constituent is an alkyl di (lower alkyl) amine oxide as denoted above and which may be represented by the following structure:

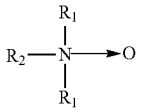

wherein each:

$R_1$ is a straight chained $C_1$-$C_4$ alkyl group, preferably both $R_1$ are methyl groups; and, $R_2$ is a straight chained $C_8$-$C_{18}$ alkyl group, preferably is $C_{10}$-$C_{14}$ alkyl group, most preferably is a $C_{12}$ alkyl group.

Each of the alkyl groups may be linear or branched, but most preferably are linear. Most preferably the amine oxide constituent is lauryl dimethyl amine oxide. Technical grade mixtures of two or more amine oxides may be used, wherein amine oxides of varying chains of the $R_2$ group are present. Preferably, the amine oxides used in the present invention include $R_2$ groups which comprise at least 50% wt., preferably at least 60% wt. of $C_{12}$ alkyl groups and at least 25% wt. of $C_{14}$ alkyl groups, with not more than 15% wt. of $C_{16}$, $C_{18}$ or higher alkyl groups as the $R_2$ group.

Still further exemplary useful nonionic surfactants which may be used include certain alkanolamides including monoethanolamides and diethanolamides, particularly fatty monoalkanolamides and fatty dialkanolamides.

A cationic surfactant may be incorporated as a germicide or as a detersive surfactant in the treatment composition of the present invention, particularly wherein a bleach constituent is absent from the treatment composition. Cationic surfactants are per se, well known, and exemplary useful cationic surfactants may be one or more of those described for example in *McCutcheon's Functional Materials*, Vol. 2, 1998; *Kirk-Othmer, Encyclopedia of Chemical Technology,* 4th Ed., Vol. 23, pp. 481-541 (1997), the contents of which are herein incorporated by reference. These are also described in the respective product specifications and literature available from the suppliers of these cationic surfactants.

Examples of preferred cationic surfactant compositions useful in the practice of the instant invention are those which provide a germicidal effect to the concentrate compositions, and especially preferred are quaternary ammonium compounds and salts thereof, which may be characterized by the general structural formula:

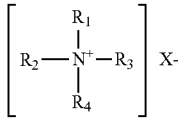

where at least one of $R_1$, $R_2$, $R_3$ and $R_4$ is a alkyl, aryl or alkylaryl substituent of from 6 to 26 carbon atoms, and the entire cation portion of the molecule has a molecular weight of at least 165. The alkyl substituents may be long-chain alkyl, long-chain alkoxyaryl, long-chain alkylaryl, halogen-substituted long-chain alkylaryl, long-chain alkylphenoxyalkyl, arylalkyl, etc. The remaining substituents on the nitrogen atoms other than the abovementioned alkyl substituents are hydrocarbons usually containing no more than 12 carbon atoms. The substituents $R_1$, $R_2$, $R_3$ and $R_4$ may be straight-chained or may be branched, but are preferably straight-chained, and may include one or more amide, ether or ester linkages. The counterion X may be any salt-forming anion which permits water solubility of the quaternary ammonium complex.

Exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide, ether or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Preferred quaternary ammonium compounds which act as germicides and which are be found useful in the practice of the present invention include those which have the structural formula:

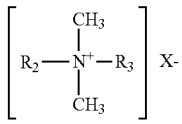

wherein $R_2$ and $R_3$ are the same or different $C_8$-$C_{12}$alkyl, or $R_2$ is $C_{12-16}$alkyl, $C_{8-18}$alkylethoxy, $C_{8-18}$alkylphenolethoxy and $R_3$ is benzyl, and X is a halide, for example chloride, bromide or iodide, or is a methosulfate anion. The alkyl groups recited in $R_2$ and $R_3$ may be straight-chained or branched, but are preferably substantially linear.

Particularly useful quaternary germicides include composicavity of the devicetions which include a single quaternary compound, as well as mixtures of two or more different quaternary compounds. Such useful quaternary compounds are available under the BARDAC®, BARQUAT®, HYAMINE®, LONZABAC®, and ONYXIDE® trademarks, which are more fully described in, for example, *McCutcheon's Functional Materials* (Vol. 2), North American Edition, 1998, as well as the respective product literature from the suppliers identified below. For example, BARDAC® 205M is described to be a liquid containing alkyl dimethyl benzyl ammonium chloride, octyl decyl dimethyl ammonium chloride; ehydra dimethyl ammonium chloride, and dioctyl dimethyl ammonium chloride (50% active) (also available as 80% active (BARDAC® 208M)); described generally in McCutcheon's as a combination of alkyl dimethyl benzyl ammonium chloride and dialkyl dimethyl ammonium chloride); BARDAC® 2050 is described to be a combination of octyl decyl dimethyl ammonium chloride/ehydra dimethyl ammonium chloride, and dioctyl dimethyl ammonium chloride (50% active) (also available as 80% active (BARDAC® 2080)); BARDAC® 2250 is described to be ehydra dimethyl ammonium chloride (50% active); BARDAC® LF (or BARDAC®LF-80), described as being based on dioctyl dimethyl ammonium chloride (BARQUAT® MB-50, MX-50, OJ-50 (each 50% liquid) and MB-80 or MX-80 (each 80% liquid) are each described as an alkyl dimethyl benzyl ammonium chloride; BARDAC® 4250 and BARQUAT® 4250Z (each 50% active) or BARQUAT® 4280 and BARQUAT 4280Z (each 80% active) are each described as alkyl dimethyl benzyl ammonium chloride/alkyl dimethyl ethyl benzyl ammonium chloride. Also, HYAMINE® 1622, described as diisobutyl phenoxy ethoxy ethyl dimethyl benzyl ammonium chloride (50% solution); HYAMINE® 3500 (50% actives), described as alkyl dimethyl benzyl ammonium chloride (also available as 80% active (HYAMINE® 3500-80)); and HYMAINE® 2389 described as being based on methyldodecylbenzyl ammonium chloride and/or methyldodecylxylene-bis-trimethyl ammonium chloride. (BARDAC®, BARQUAT® and HYAMINE® are presently commercially available from Lonza, Inc., Fairlawn, N.J.). BTC® 50 NF (or BTC® 65 NF) is described to be alkyl dimethyl benzyl ammonium chloride (50% active); BTC® 99 is described as ehydra dimethyl ammonium chloride (50% active); BTC® 776 is described to be myrisalkonium chloride (50% active); BTC® 818 is desctreatment compositions can take any of a variety of forms. In one preferred form, the treatment compositions are compressed solid block compositions which are inserted into, or provided into the interior of the hollowribed as being octyl decyl dimethyl ammonium chloride, ehydra dimethyl ammonium chloride, and dioctyl dimethyl ammonium chloride (50% active) (available also as 80% active (BTC® 818-80%)); BTC® 824 and BTC® 835 are each described as being of alkyl dimethyl benzyl ammonium chloride (each 50% active); BTC® 885 is described as a combination of BTC® 835 and BTC® 818 (50% active) (available also as 80% active (BTC® 888)); BTC® 1010 is described as decahydra dimethyl ammonium chloride (50% active) (also available as 80% active (BTC® 1010-80)); BTC® 2125 (or BTC® 2125 M) is described as alkyl dimethyl benzyl ammonium chloride and alkyl dimethyl ethylbenzyl ammonium chloride (each 50% active) (also available as 80% active (BTC® 2125 80 or BTC® 2125 M)); BTC® 2565 is described as alkyl dimethyl benzyl ammonium chlorides (50% active) (also available as 80% active (BTC® 2568)); BTC® 8248 (or BTC® 8358) is described as alkyl dimethyl benzyl ammonium chloride (80% active) (also available as 90% active (BTC® 8249)); ONYXIDE® 3300 is described as n-alkyl dimethyl benzyl ammonium saccharinate (95% active). (BTC® and ONYXIDE® are presently commercially available from Stepan Company, Northfield, Ill.) Polymeric quaternary ammonium salts based on these monomeric structures are also considered desirable for the present invention. One example is POLYQUAT®, described as being a 2-butenyldimethyl ammonium chloride polymer.

Preferred quaternary germicides used in the treatment compositions are those which are supplied in a solid or powdered form, as such greatly facilitates the manufacture of the treatment compositions.

When present in a treatment composition, it is preferred that the germicidal cationic surfactant(s) are present in amounts so to dispense at least about 200 parts per million (ppm) in the water flushed into the sanitary appliance, e.g., toilet bowl, or into the water retained in the sanitary appliance at the conclusion of the flush cycle.

Further detersive surfactants which may be included in the treatment compositions are amphoteric and zwitterionic surfactants which provide a detersive effect. Exemplary useful amphoteric surfactants include alkylbetaines, particularly those which may be represented by the following structural formula:

$$RN^{+}(CH_3)_2CH_2COO^{-}$$

wherein R is a straight or branched hydrocarbon chain which may include an aryl moiety, but is preferably a straight hydrocarbon chain containing from about 6 to 30 carbon atoms. Further exemplary useful amphoteric surfactants include amidoalkylbetaines, such as amidopropylbetaines which may be represented by the following structural formula:

$$RCONHCH_2CH_2CH_2N^{+}(CH_3)_2CH_2COO^{-}$$

wherein R is a straight or branched hydrocarbon chain which may include an aryl moiety, but is preferably a straight hydrocarbon chain containing from about 6 to 30 carbon atoms. When present, such one or more detersive surfactants may be present in any effective amount, and may comprise from 0.001% to 100% wt. of the treatment composition.

Further exemplary chemical constituents may be one or more sanitizing agents or germicides which may be present with our without other constituents being present in the treatment compositions of the lavatory dispensing devices.

The sanitizing agent can be any sanitizing composition known to those of ordinary skill in the relevant art, and without limitation exemplary sanitizing compositions include materials containing alkyl halohydantoins, alkali metal haloisocyanurates, bleach, essential oils, non-quaternary ammonium based germicidal compounds as well as quaternary ammonium germicidal compounds.

By way of non-limiting example is a bleach constituent. The bleach constituent is relatively inert in the dry state but, which on contact with water, releases oxygen, hypohalite or a halogen especially chlorine. Representative examples of typical oxygen-release bleaching agents, suitable for incorporation in the treatment composition include the alkali metal perborates, e.g., sodium perborate, and alkali metal monopersulfates, e.g., sodium monopersulfates, potassium monopersulfate, alkali metal monoperphosphates, e.g., disodium monoperphosphate and dipotassium monoperphosphate, as well as other conventional bleaching agents capable of liberating hypohalite, e.g., hypochlorite and/or hypobromite, include heterocyclic N-bromo- and N-chloro-cyanurates such as trichloroisocyanuric and tribromoiscyanuric acid, dibromocyanuric acid, dichlorocyanuric acid, N-monobromo-N-mono-chlorocyanuric acid and N-monobromo-N, N-dichlorocyanuric acid, as well as the salts thereof with water solubilizing cations such as potassium and sodium, e.g., sodium N-monobromo-N-monochlorocyanurate, potassium dichlorocyanurate, sodium dichlorocyanurate, as well as other N-bromo and N-chloro-imides, such as N-brominated and N-chlorinated succinimide, malonimide, phthalimide and naphthalimide. Also useful in the treatment composition as hypohalite-releasing bleaches are halohydantoins which may be used include those which may be represented by the general structure:

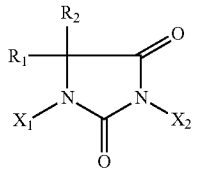

wherein:

$X_1$ and $X_2$ are independently hydrogen, chlorine or bromine; and, $R_1$ and $R_2$ are independently alkyl groups having from 1 to 6 carbon atoms.

Examples of halohydantoins include, for example, N,N'-dichloro-dimethyl-hydantoin, N-bromo-N-chloro-dimethylhydantoin, N,N'-dibromo-dimethyl-hydantoin, 1,4-dichloro, 5,5-dialkyl substituted hydantoin, wherein each alkyl group independently has 1 to 6 carbon atoms, N-monohalogenated hydantoins such as chlorodimethylhydantoin (MCDMH) and N-bromo-dimethylhydantoin (MBDMH); dihalogenated hydantoins such as dichlorodimethylhydantoin (DCDMH), dibromodimethylhydantoin (DBDMH), and 1-bromo-3-chloro-5,5,-dimethylhydantoin (BCDMH); and halogenated methylethylhydantoins such as chloromethylethylhydantion (MCMEH), dichloromethylethylhydantoin (DCMEH), bromomethylethylhydantoin (MBMEH), dibromomethylethylhydantoin (DBMEH), and bromochloromethylethylhydantoin (BCMEH), and mixtures thereof. Other suitable organic hypohalite liberating bleaching agents include halogenated melamines such as tribromomelamine and trichloromelamine. Suitable inorganic hypohalite-releasing bleaching agents include lithium and calcium hypochlorites and hypobromites. The various chlorine, bromine or hypohalite liberating agents may, if desired, be provided in the form of stable, solid complexes or hydrates, such as sodium p-toluene sulfobromamine trihydrate; sodium benzene sulfochloramine dehydrate; calcium hypobromite tetrahydrate; and calcium hypochlorite tetrahydrate. Brominated and chlorinated trisodium phosphates formed by the reaction of the corresponding sodium hypohalite solution with trisodium orthophosphate (and water, as necessary) likewise comprise useful inorganic bleaching agents for incorporation into the inventive treatment composition and the treatment blocks formed therefrom.

When present, preferably the bleach constituent is a hypohalite liberating compound and more preferably is a hypohalite liberating compound in the form of a solid complex or hydrate thereof. Particularly preferred are chloroisocynanuric acids and alkali metal salts thereof, preferably potassium, and especially sodium salts thereof. Examples of such compounds include trichloroisocyananuric acid, dichloroisocyanuric acid, sodium dichloroisocyanurate, potassium dichloroisocyanurate, and trichloro-potassium dichloroisocynanurate complex. The most preferred chlorine bleach material is sodium dichloroisocyanurate; the ehydrate of this material being particularly preferred.

When present, the bleach constituent may be present in any effective amount and may comprise up to about 90% wt., preferably at least about 0.01-100% wt of the treatment composition.

Other germicidally effective agents useful as sanitizing agents include sodium dichloroisocyanurate (DCCNa) and sodium dibromoisocyanurate. Further examples of non-quaternary ammonium based sanitizing agents include pyrithiones, dimethyldimethylol hydantoin, methylchloroisothiazolinone/methylisothiazolinone sodium sulfite, sodium bisulfite, imidazolidinyl urea, diazolidinyl urea, benzyl alcohol, 2-bromo-2-nitropropane-1,3-diol, formalin (formaldehyde), iodopropenyl butylcarbamate, chloroacetamide, methanamine, methyldibromonitrile glutaronitrile, glutaraldehyde, 5-bromo-5-nitro-1,3-dioxane, phenethyl alcohol, o-phenylphenol/sodium o-phenylphenol, sodium hydroxymethylglycinate, polymethoxy bicyclic oxazolidine, dimethoxane, thimersal dichlorobenzyl alcohol, captan, chlorphenenesin, dichlorophene, chlorbutanol, glyceryl laurate, halogenated diphenyl ethers, phenolic compounds, mono- and poly-alkyl and aromatic halophenols, resorcinol and its derivatives, bisphenolic compounds, benzoic esters (parabens), halogenated carbanilides, 3-trifluoromethyl-4,4'-dichlorocarbanilide, and 3,3',4-trichlorocarbanilide. More preferably, the non-cationic antimicrobial agent is a mono- and poly-alkyl and aromatic halophenol selected from the group p-chlorophenol, methyl p-chlorophenol, ethyl p-chlorophenol, n-propyl p-chlorophenol, n-butyl p-chlorophenol, n-amyl p-chlorophenol, sec-amyl p-chlorophenol, n-hexyl p-chlorophenol, cyclohexyl p-chlorophenol, n-heptyl p-chlorophenol, n-octyl p-chlorophenol, o-chlorophenol, methyl o-chlorophenol, ethyl o-chlorophenol, n-propyl o-chlorophenol, n-butyl o-chlorophenol, n-amyl o-chlorophenol, tert-amyl o-chlorophenol, n-hexyl o-chlorophenol, n-heptyl o-chlorophenol, o-benzyl p-chlorophenol, o-benzyl-m-methyl p-chlorophenol, o-benzyl-m, m-dimethyl p-chlorophenol, o-phenylethyl p-chlorophenol, o-phenylethyl-m-methyl p-chlorophenol, 3-methyl p-chlorophenol, 3,5-dimethyl p-chlorophenol, 6-ethyl-3-methyl p-chlorophenol, 6-n-propyl-3-methyl p-chlorophenol, 6-iso-propyl-3-methyl p-chlorophenol, 2-ethyl-3,5-dimethyl p-chlorophenol, 6-sec-butyl-3-methyl p-chlorophenol, 2-iso-propyl-3,5-dimethyl p-chlorophenol, 6-diethylmethyl-3-methyl p-chlorophenol, 6-iso-propyl-2-ethyl-3-methyl p-chlorophenol, 2-sec-amyl-3,5-dimethyl p-chlorophenol 2-diethylmethyl-3,5-dimethyl p-chlorophenol, 6-sec-octyl-3-methyl p-chlorophenol, p-chloro-m-cresol, p-bromophenol, methyl p-bromophenol, ethyl p-bromophenol, n-propyl p-bromophenol, n-butyl p-bromophenol, n-amyl p-bromophenol, sec-amyl p-bromophenol, n-hexyl p-bromophenol, cyclohexyl p-bromophenol, o-bromophenol, tert-amyl o-bromophenol, n-hexyl o-bromophenol, n-propyl-m,m-dimethyl o-bromophenol, 2-phenyl phenol, 4-chloro-2-methyl phenol, 4-chloro-3-methyl phenol, 4-chloro-3,5-dimethyl phenol, 2,4-dichloro-3,5-dimethylphenol, 3,4,5,6-terabromo-2-methylphenol, 5-methyl-2-pentylphenol, 4-isopropyl-3-methylphenol, para-chloro-meta-xylenol, dichloro meta xylenol, chlorothymol, and 5-chloro-2-hydroxydiphenylmethane.

Quaternary ammonium based sanitizing agents include any cationic surfactant which is known or may be found to provide a broad antibacterial or sanitizing function; these have been described above with reference to detersive surfactants.

As a further chemical constituent, the treatment compositions of the invention may also comprise a coloring agent which imparts either a color to treatment compositions and/or to the water in which it comes into contact, but especially which imparts color to the water contained within the sanitary appliance. Where the sanitary appliance is a toilet, desirably the coloring agent imparts a color to the water contained within the toilet bowl particularly following the flush cycle of a toilet. Such coloring agents have great consumer appeal, and indeed any known art coloring agent may be provided in any effective amount in order to impart a coloring effect. Colorants, especially dyes, are preferred when formulated as dry powders to enable direct incorporation into treatment compositions of the invention, however, liquid colorants may be employed in conjunction with suitable carriers. Useful colorants include any materials which may provide a desired coloring effect. Exemplary useful coloring agents include dyes, e.g., Alizarine Light Blue B (C.I. 63010), Carta Blue VP (C.I. 24401), Acid Green 2G (C.I. 42085), Astragon Green D (C.I. 42040) Supranol Cyanine 7B (C.I. 42675), Maxilon Blue 3RL (C.I. Basic Blue 80), acid yellow 23, acid violet 17, a direct violet dye (Direct violet 51), Drimarine Blue Z-RL (C.I. Reactive Blue 18), Alizarine Light Blue H-RL (C.I. Acid Blue 182), FD&C Blue No. 1, FD&C Green No. 3 and Acid Blue No. 9. When a bleach constituent is included in the treatment composition, the colorant, e.g., dye, should be selected so to ensure the compatibility of the colorant with the bleach constituent, or so that its color persists despite the presence in the toilet bowl of a concentration of hypochlorite which is effective to maintain sanitary conditions. Frequently however, a treatment composition which includes a bleach constituent do not comprise any colorants. Desirably the colorants, when present, do not exceed 15% wt. of the treatment composition, although generally lesser amounts are usually effective. When present, colorants are desirably present in an amount from about 0.1 to 15 percent of the total weight of the treatment composition.

The treatment compositions may include a fragrance or other air treatment constituent. The fragrance may be any composition which is known to the art to provide a perceptible fragrancing benefit, any may be based on naturally occurring materials such as one or more essential oils, or may be based on synthetically produced compounds as well. Examples of essential oils include pine oil, Anetlhole 20/21 natural, Aniseed oil china star, Aniseed oil globe brand, Balsam (Perui), Basil oil (India), Black pepper oil, Black pepper oleoresin 40/20, Bois de Rose (Brazil) FOB, Bomneol Flakes (China), Camphor oil, White, Camphor powder synthetic technical, Canaga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Counmarin 69° C. (China), Cyclamen Aldehyde, Diphenyl oxide, Ethyl ehydrat, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), and Wintergreen oil.

Many of these essential oils function as a fragrance agent, which fragrance agent which may be a substance or mixture of various substances including those which are naturally derived (i.e., obtained by extraction of flower, herb, blossom or plant), those which are artificially derived or produced (i.e., mixture of natural oils and/or oil constituents), and those which are synthetically produced substances (odiferous substances). Generally fragrance agents are complex mixtures or blends various organic compounds including, but not limited to, certain alcohols, aldehydes, ethers, alamatic compounds and varying amounts of essential oils such as from about 0 to about 25% by weight, usually from about 0.05 to about 12% by weight, the essential oils themselves being volatile odiferous compounds and also functioning to aid in the dissolution of the other components of the fragrance agent. In the present invention, the precise composition of the fragrance agent desirably emanates a pleasing fragrance, but the nature of the fragrance agent is not critical to the success of the invention.

As noted above, in conjunction with or in the absence of a fragrance constituent, the treatment compositions may comprise an air treatment constituent. Such may be any other material which is useful in providing treatment of ambient air, such as a sanitizing agents. e.g., one or more glycols or alcohols, or materials which are intended to counteract, neutralize, or mask odors in the absence of, or in conjunction with, the fragrance composition of the present invention. Alternatively, the air treatment constituent may be one or more materials which provide and effective insecticide repelling or insecticidal benefit; such would be particularly useful in climates or environments where insects present a nuisance or health hazard.

In certain embodiments of the invention, when present, such an air treatment composition and/or fragrance composition may be provided separately from the treatment compositions. For example, such an air treatment composition and/or fragrance composition may be provided in a reservoir comprising a quantity of an air treatment composition and/or fragrance composition which may form part of or be used with the lavatory treatment device. Such a reservoir can take any shape or suitable form, and can be included within the interior of the device, or on the exterior of the device, or may be even be separate from the device but provided as a separate article or element which is separate or separable from the device but intended to be placed in the near proximity of the device, e.g. attached to another part of the toilet or lavatory appliance or nearby to the toilet or lavatory appliance. By way of nonlimiting examples, such a reservoir may include a porous material such as a pad or tablet which is impregnated with, or upon which is absorbed a volatile composition useful in providing an air treatment benefit, a gel or a solid composition which also contains a volatile air treatment composition which may emanate from the reservoir. Alternately the reservoir may contain a quantity of a particulate material in the form of a single body, e.g. plate, or as a plurality of spheres, or beads which function as a reservoir for an air treatment composition and/or fragrance composition, and from whence they may be delivered to the ambient environment. Non-limiting examples of such materials include those currently marketed under the tradename Auracell® (ex. Rotuba Extruders) which are based on fragranced cellulosic polymers, as well as PolyIFF® (ex. International Flavors and Fragrances Inc.), as well as Tenite® (ex. Eastman Chemical Co.).

As further chemical constituents, the treatment compositions of the invention may comprise an anti-limescale agent, which can be generally classified as a cleaning agent in that it provides a cleaning effect to treated lavatory device surfaces. The anti-limescale agent can virtually any known anti-limescale agent compositions known to those of ordinary skill in the relevant art. For example, compositions containing anionic and/or nonionic surfactants together with typical anti-limescale agents, for example, amidosulfonic acid, bisulfate salts, organic acids, organic phosphoric salts, alkali metal polyphosphates, and the like. Examples of anti-limescale agent compositions can be found in, for example, U.S. Pat. Nos. 5,759,974; 4,460,490; and 4,578,207, the contents of which are herein incorporated by reference. Further examples of anti-limescale agents include organic acids (for example, citric acid, lactic acid, adipic acid, oxalic acid and the like), organic phosphoric salts, alkali metal polyphosphates, sulfonic, and sulfamic acids and their salts, bisulfate salts, EDTA, phosphonates, and the like.

The treatment compositions may comprise stain inhibiting materials. The treatment composition of the invention may, for example, include an effective amount of a manganese stain inhibiting agent which is advantageously included wherein the sanitary appliance is supplied by a water source having an appreciable or high amount of manganese. Such water containing a high manganese content are known to frequently deposit unsightly stains on surfaces of sanitary appliances, especially when the treatment composition also contains a bleach source which provides a hypochlorite. To counteract such an effect the treatment composition of the present invention may comprise a manganese stain inhibiting agent, such as a partially hydrolyzed polyacrylamide having a molecular weight of about 2000 to about 10,000, a polyacrylate with a molecular weight of about 2000 to about 10,000, and/or copolymers of ethylene and maleic acid anhydride with a molecular weight of from about 20,000 to about 100,000. When present the satin inhibiting materials may comprise to about 10% wt. of the weight of the treatment composition.

The treatment compositions of the invention may include one or more preservatives. Such preservatives are primarily included to reduce the growth of undesired microorganisms within the treatment blocks formed from the treatment composition during storage prior to use or while used, although it is expected that the such a preservative may impart a beneficial antimicrobial effect to the water in the sanitary appliance to which the treatment block is provided. Exemplary useful preservatives include compositions which include parabens, including methyl parabens and ethyl parabens, glutaraldehyde, formaldehyde, 2-bromo-2-nitropropoane-1,3-diol, 5-chloro-2-methyl-4-isothiazolin-3-one, 2-methyl-4-isothiazoline-3-one, and mixtures thereof. One exemplary composition is a combination 5-chloro-2-methyl-4-isothiazolin-3-one and 2-methyl-4-isothiazolin-3-one where the amount of either component may be present in the mixture anywhere from 0.001 to 99.99 weight percent, based on the total amount of the preservative. For reasons of availability, the most preferred preservative are those commercially available preservative comprising a mixture of 5-chloro-2-methyl-4-isothiazolin-3-one and 2-methyl-4-isothiazolin-3-one marketed under the trademark KATHON® CG/ICP as a preservative composition presently commercially available from Rohm and Haas (Philadelphia, Pa.). Further useful preservative compositions include KATHON® CG/ICP II, a further preservative composition presently commercially available from Rohm and Haas (Philadelphia, Pa.), PROXEL® which is presently commercially available from Zeneca Biocides (Wilmington, Del.), SUTTOCIDE® A which is presently commercially available from Sutton Laboratories (Chatam, N.J.) as well as TEXTAMER® 38AD which is presently commercially available from Calgon Corp. (Pittsburgh, Pa.). When present, the optional preservative constituent should not exceed about 5% wt. of the treatment composition, although generally lesser amounts are usually effective.

The treatment compositions may include a binder constituent. The binder may function in part controlling the rate of dissolution of the tablet. The binder constituent may be a clay, but preferably is a water-soluble or water-dispersible gel-forming organic polymer. The term "gel-forming" as applied to this polymer is intended to indicate that on dissolution or dispersion in water it first forms a gel which, upon dilution with further water, is dissolved or dispersed to form a free-flowing liquid. The organic polymer serves essentially as binder for the tablets produced in accordance with the invention although, as will be appreciated, certain of the polymers envisaged for use in accordance with the invention also have surface active properties and thereby serve not only as binders but also enhance the cleansing ability of the tablets of the invention. Further certain organic polymers, such as substituted celluloses, also serve as soil antiredeposition agents. A wide variety of water-soluble organic polymers are suitable for use in the treatment composition of the present invention. Such polymers may be wholly synthetic or may be semi-synthetic organic polymers derived from natural materials. Thus, for example, on class of organic polymers for use in accordance with the invention are chemically modified celluloses such as ethyl cellulose, methyl cellulose, sodium carboxymethyl cellulose, hydroxypropyl cellulose, hydroxypropyl methyl cellulose, ethyl hydroxyethyl cellulose, carboxymethyl hydroxyethyl cellulose, and hydroxyethyl cellulose. Another class of organic polymers which may be used include naturally derived or manufactured (fermented) polymeric materials such as alginates and carageenan. Also, water-soluble starches and gelatin may be used as the optional binder constituent. The cellulose based binders are a preferred class of binders for use in the treatment composition and may possess the property of inverse solubility that is their solubility decreases with increasing temperature, thereby rendering the tablets of the invention suitable for use in locations having a relatively high ambient temperature.

The optional binder constituent may also be one or more synthetic polymers e.g., polyvinyl alcohols; water-soluble partially hydrolyzed polyvinyl acetates; polyacrylonitriles; polyvinyl pyrrolidones; water-soluble polymers of ethylenically unsaturated carboxylic acids, such as acrylic acid and methacrylic acid, and salts thereof; base-hydrolysed starch-polyacrylonitrile copolymers; polyacrylamides; ethylene oxide polymers and copolymers; as well as carboxypolymethylenes.

The treatment composition may optionally include one or more dissolution control agents. Such dissolution control agent are materials which provide a degree of hydrophobicity to the treatment block formed from the treatment composition whose presence in the treatment block contributes to the slow uniform dissolution of the treatment block when contacted with water, and simultaneously the controlled release of the active constituents of the treatment composition. Preferred for use as the dissolution control agents are mono- or di-alkanol amides derived from $C_8$-$C_{16}$ fatty acids, especially $C_{12}$-$C_{14}$ fatty acids having a $C_2$-$C_6$ monoamine or diamine moiety. When included the dissolution control agent may be included in any effective amount, but desirably the dissolution control agent is present in an amount not to exceed about 600% wt. of the treatment composition, although generally lesser amounts are usually effective. Generally when present, the dissolution control agent is present from about 0.1% wt. to about 15% wt., based on the total weight of the treatment compositions of which they form a part The treatment compositions may optionally include one or more water-softening agents or one or more chelating agents, for example inorganic water-softening agents such as sodium hexametaphosphate or other alkali metal polyphosphates or organic water-softening agents such as ethylenediaminetetraacetic acid and nitrilotriacetic acid and alkali metal salts thereof. When present, such water-softening agents or chelating agents should not exceed about 50% wt. of the treatment composition, although generally lesser amounts are usually effective.

The treatment composition may optionally include one or more solid water-soluble acids or acid-release agents such as sulphamic acid, citric acid or sodium hydrogen sulphate. When present, such solid water-soluble acids or acid-release agents should not exceed about 50% wt. of the treatment composition, although generally lesser amounts are usually effective.

The treatment composition may include diluent materials may be included to provide additional bulk of the product treatment composition and may enhance leaching out of the surfactant constituent when the treatment composition is placed in water. Exemplary diluent materials include any soluble inorganic alkali, alkaline earth metal salt or hydrate thereof, for example, chlorides such as sodium chloride, magnesium chloride and the like, carbonates and bicarbonates such as sodium carbonate, sodium bicarbonate and the like, sulfates such as magnesium sulfate, copper sulfate, sodium sulfate, zinc sulfate and the like, borax, borates such as sodium borate and the like, as well as others known to the art but not particularly recited herein. Exemplary organic diluents include, inter alia, urea, as well as water soluble high molecular weight polyethylene glycol and polypropylene glycol. When present, such diluent materials should not exceed about 80% wt. of the treatment composition, although generally lesser amounts are usually effective. Preferably a sulfate salt, e.g., magnesium sulfate, copper sulfate, sodium sulfate, zinc sulfate and the like, and particularly sodium sulfate is necessarily present in the treatment composition and treatment blocks formed therefrom.

The treatment composition and treatment blocks formed therefrom may include one or more fillers. Such fillers are typically particulate solid water-insoluble materials which may be based on inorganic materials such as talc or silica, particulate organic polymeric materials such as finely comminuted water insoluble synthetic polymers. When present, such fillers should not exceed about 50% wt. of the treatment composition, although generally lesser amounts are usually effective.

The treatment composition and treatment blocks formed therefrom may include one or more further processing aids. For example, the treatment composition may also include other binding and/or plasticizing ingredients serving to assist in the manufacture thereof, for example, polypropylene glycol having a molecular weight from about 300 to about 10,000 in an amount up to about 20% by weight, preferably about 4% to about 15% by weight of the mixture may be used. The polypropylene glycol reduces the melt viscosity, acts as a demolding agent and also acts to plasticize the block when the composition is prepared by a casting process. Other suitable plasticizers such as pine oil fractions, d-limonene, dipentene and the ethylene oxide-propylene oxide block copolymers may be utilized. Other useful processing aids include tabletting lubricants such as metallic stearates, stearic acid, paraffin oils or waxes or sodium borate which facilitate in the formation of the treatment blocks in a tabletting press or die.

One advantageously utilized processing aid is a diester constituent which may be represented by the following structure:

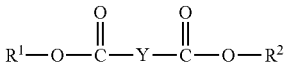

wherein:

$R^1$ and $R^2$ can independently be $C_1$-$C_6$ alkyl which may optionally substituted, Y is $(CH_2)_x$, wherein x is 0-10, but is preferably 1-8, and while Y may be a linear alkyl or phenyl moiety, desirably Y includes one or more oxygen atoms and/or is a branched moiety.

Exemplary diester constituents include the following diester compounds according to the foregoing structure: dimethyl oxalate, diethyl oxalate, diethyl oxalate, dipropyl oxalate, dibutyl oxalate, diisobutyl oxalate, dimethyl succinate, diethyl succinate, diethylhexyl succinate, dimethyl glutarate, diisostearyl glutarate, dimethyl adipate, diethyl adipate, diisopropyl adipate, dipropyl adipate, dibutyl adipate, diisobutyl adipate, dihexyladipate, di-$C_{12-15}$-alkyl adipate, dicapryl adipate, dicetyl adipate, diisodecyl adipate, diisocetyl adipate, diisononyl adipate, diheptylundecyl adipate, ditridecyl adipate, diisostearyl adipate, diethyl sebacate, diisopropyl sebacate, dibutyl sebacate, diethylhexylsebacate, diisocetyl dodecanedioate, dimethyl brassylate, dimethyl phthalate, diethyl phthalate, dibutyl phthalate.

Preferred diester constituents include those wherein Y is —$(CH_2)_x$— wherein x has a value of from 0-6, preferably a value of 0-5, more preferably a value of from 1-4, while $R^1$ and $R^2$ are $C_1$-$C_6$ alkyl groups which may be straight chained alkyl but preferably are branched, e.g., iso- and tert-moieties. Particularly preferred diester compounds are those in which the compounds terminate in ester groups.

A further advantageously utilized processing aid is a hydrocarbon solvent constituent. The hydrocarbon solvents are immiscible in water, may be linear or branched, saturated or unsaturated hydrocarbons having from about 6 to about 24 carbon atoms, preferably comprising from about 12 to about 16 carbon atoms. Saturated hydrocarbons are preferred, as are branched hydrocarbons. Such hydrocarbon solvents are typically available as technical grade mixtures of two or more specific solvent compounds, and are often petroleum distillates. Nonlimiting examples of some suitable linear hydrocarbons include decane, dodecane, decene, tridecene, and combinations thereof. Mineral oil is one particularly preferred form of a useful hydrocarbon solvent. Further preferred hydrocarbon solvents include paraffinic hydrocarbons including both linear and branched paraffinic hydrocarbons. The former are commercially available as NORPAR solvents (ex. ExxonMobil Corp.) while the latter are available as ISOPAR solvents (ex. ExxonMobil Corp.) Mixtures of branched hydrocarbons especially as isoparaffins form a further particularly preferred form of a useful hydrocarbon solvent of the invention. Particularly useful technical grade mixtures of isoparaffins include mixtures of isoparaffinic organic solvents having a relatively narrow boiling range. Examples of these commercially available isoparaffinic organic solvents include ISOPAR C described to be primarily a mixture of $C_7$-$C_8$ isoparaffins, ISOPAR E described to be primarily a mixture of $C_8$-$C_9$ isoparaffins, ISOPAR G described to be primarily a mixture of $C_{10}$-$C_{11}$ isoparaffins, ISOPAR H described to be primarily a mixture of $C_{11}$-$C_{12}$ isoparaffins, ISOPAR J, ISOPAR K described to be primarily a mixture of $C_{11}$-$C_{12}$ isoparaffins, ISOPAR L described to be primarily a mixture of $C_{11}$-$C_{13}$ isoparaffins, ISOPAR M described to be primarily a mixture of $C_{13}$-$C_{14}$ isoparaffins, ISOPAR P and ISOPAR V described to be primarily a mixture of $C_{12}$-$C_{20}$ isoparaffins.

When present, such further processing aids are typically included in amounts of up to about 50% by weight, preferably to 20% wt. of the treatment composition, although generally lesser amounts are usually effective.

The treatment compositions may be provided in any of a number of forms. In certain preferred embodiments the treatment composition may be provided in the form of at tablet, cake or block which is formed by extrusion and/or tabletting of the treatment composition into suitably sized tablets, cakes or blocks. Alternately the treatment composition may be in the form of a gel, especially as self-supporting gel.

While the mass of the treatment compositions formed from the treatment compositions may vary, and amount of up to an including 500 grams may be practiced, generally the mass of the treatment compositions do not exceed about 250 grams. Advantageously the mass of the treatment compositions is between about 50 and 150 grams. It is appreciated that treatment compositions having great mass should provide a longer useful service life of the lavatory dispensing devices, with the converse being equally true.

It will be appreciated by those of ordinary skill in the art that several of the components which are directed to provide a chemical composition can be blended into one chemical composition with the additional appreciation that potential blending of incompatible components will be avoided. For example, those of ordinary skill in the art will appreciate that certain anionic surfactants may have to be avoided as some may be incompatible with certain sanitizing agents and/or certain anti-lime scale agents mentioned herein. Those of ordinary skill in the art will appreciate that the compatibility of the anionic surfactant and the various sanitizing and anti-limescale agents can be easily determined and thus incompatibility can be avoided in the situations.

The treatment compositions may be formed of a single treatment composition, or may formed of two (or more) different treatment composition which may be provided as separate regions of a solid block, such as a first layer of a solid block consisting of a first treatment composition, alongside a second layer of a second treatment composition which is different than the first treatment composition, such a solid block may also be formed of two or more separate blocks which are simply layered or otherwise assembled, without or without the use of an adhesive. Further layers of still further different chemical compositions may also be present. Such treatment compositions formed having two or more discrete layers or regions of, respectively, two or more different chemical compositions or different treatment compositions may be referred to as composite blocks.

The treatment compositions according to the present invention may also be formed of two or more separate blocks which are simply layered or otherwise assembled, without or without the use of an adhesive. Alternately the solid block may be physically separated from one another such as by a plate or other physical barrier element, or more simply, by providing a simple gap between two masses or bodies of lavatory block compositions. Such latter embodiments provide a technique for using two chemically incompatible treatment compositions as parts of a single dispensing device according to the invention.

Any form of the treatment compositions may also be provided with a coating film or coating layer, such as a water soluble film which is used to overwrap the chemical composition provided in the device which film provides a vapor barrier when dry, but which dissolves when contacted with water. Alternately the treatment compositions may be oversprayed or dipped into a bath of a water soluble film forming constituent, and thereafter removed and thus allowing the water soluble film forming constituent to dry and form a coating layer on a treatment composition if the form of a table, cake or block. The provision of such a coating film or coating layer may be advantageous of the treatment composition contains hygroscopic constituents.

Exemplary materials which may be used to provide such a coating on some or all of the surfaces of the treatment compositions include one or more of the following: Rhodasurf TB-970 described by its supplier to be a tridecyl alcohol having a degree of ethoxylation of approximately 100 having an HLB of 19, and exhibiting a melting point in the range of 52-55° C.; Antarox F-108 which is described to be an EO-PO block copolymer having a degree of ethoxylation of approximately 80% and having a melting point in the range of 54-60° C.; further materials including those identified as Pluriol Z8000, and Pluriol E8000 which are believed to be optionally substituted, high molecular weight polyethylene glycols ("PEG") having a sufficiently high molecular weight such that they have a melting point of at least 25° C., preferably a melting point of at least about 30° C. may also be used. Other water soluble materials, desirably those which have a melting point in the range of about 30-70° C., and which may be used to provide a water soluble or water dispersible coating on the treatment compositions are also contemplated to be useful, especially synthetic or naturally occurring waxy materials, and high molecular weight polyalkylene glycols, especially polyethylene glycols. Certain of these coating materials may be surfactants. Generally such materials may be provided as a dispersion in water, an organic solvent or in an aqueous/organic solvent, but preferably are used as supplied from their respective supplier and are heated to at least their melting points in order to form a liquid bath. Conveniently, the treatment compositions affixed to the plate of a hanger are then conveniently dipped into the said bath, thereby providing a coating layer to the solid blocks. Alternately, the coating materials may be sprayed, brushed on or padded onto at least part of the surfaces of the previously formed solid blocks.

The application of a water soluble film or coating is preferred in certain embodiments of the invention as the surface film may facilitate the handling of the blocks during packaging and storage prior to use of the dispensing devices described herein.

The service life of the lavatory treatment devices of the invention are preferably from about 10 to about 30 days, based on approximately 12 flushes per day. Preferably the service life of the treatment compositions present within the lavatory treatment devices is at least about 21 days when the device is installed from the rim of a lavatory appliance and in the path of flush water released by the lavatory appliance. Preferably the temperature of the water which is flushed is in the range of 16-24° C. The length of service life of the lavatory dispensing device of the invention will of course depend on a variety of factors including the specific formulation of the treatment composition which it contains, water temperature, the number and frequency of flushes over the period of use and the volume of the water which contacts the treatment compositions within the lavatory dispensing device.

The improved library treatment devices according to the invention all are advantageously and preferably utilized in conjunction with the European type toilet bowl. This is due to the fact that typically, such European type toilet bowls provide a higher volume of water from beneath the rim of a toilet bowl per unit of time, as compared to North American type toilet bowls.

Various configurations of the inventive lavatory dispensing devices according to the present invention, including certain particularly preferred embodiments, are depicted on the following figures. In the accompanying figures, like elements are indicated using the same numerals throughout the figures.

FIGS. 1, 2, 3 and 4 relate to a first embodiment of a lavatory dispensing device according to the invention.

Figure 5:
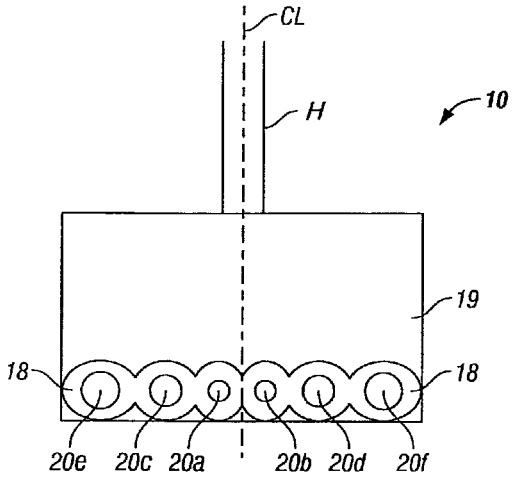
Figure 6:
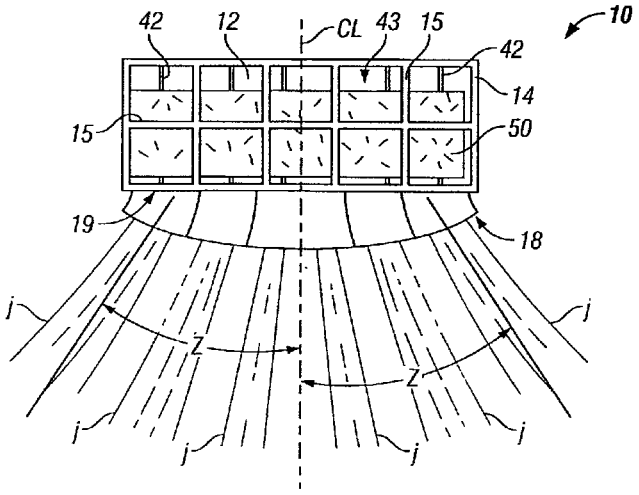

FIGS. 5 and 6 relate to a second embodiment of a lavatory dispensing device according to the invention.

FIGS. 7, 8, 9, 10, 11, and 12 relate to a third embodiment of a lavatory dispensing device according to the invention.

FIG. 1 depicts an improved lavatory dispensing device 10 according to the present invention mounted by a hanger H from the rim ("rim") of a toilet bowl 100. As can be seen in the figure, the device 10 is suspended beneath the rim and adjacent to portion of the interior sidewall 102 of the toilet bowl 100. The positioning of the device 10 is such that the inlet 12 is positioned at least partially beneath the rim such that, during a flushing operation, water exiting from beneath the rim and downwardly into the interior of the toilet bowl, passes through the inlet 12 and into the interior of the device 10. Also visible on the figure is a grill 14 which spans across the inlet 12 and includes a plurality of regularly spaced apart bars 15 intermediate which are a plurality of openings 16 which permit for the passage of flush water and into the interior of the device 10. In the instant embodiment, the hanger H is connected to part of the grill 14, more specifically to one of the bars 15. Adjacent to the base 17 and within the bottom front face 18 of the device 10 are depicted a plurality of outlets 20 which in this embodiment, are spaced apart in a generally linear arrangement with respect to one another. As is seen, there are depicted a plurality of jets "j", it more specifically six individual jets of the largely aqueous lavatory treatment composition, one of each emanating from each of the six openings 20 and, in totality foam a fan-like spray of a liquid treatment composition exiting the device 10. As is further seen, the arrangement of the openings 20 in part dictate the arrangement of the individual jets, and which also influenced the arrangement and the form of the fan-like spray of the liquid treatment composition exiting the device 10, which in the figure is seen to be generally planar. Also clearly visible is it that the direction of the jets "j" is at least initially generally perpendicular to the opening 16 and the bottom front face 18 of the device 10.

While not specifically depicted in the figures, it is to be understood that the bottom section 32 of the back wall 30 may include one or more slits or openings extending therethrough, such as slot openings (see 62, 64 of FIG. 9) which permit for the egress of a part of the largely aqueous lavatory treatment composition through the bottom section 32 of the back wall 30. An advantage of including such one or more slits or openings are that it provides for a quantity of the lavatory treatment composition formed within the interior of the device to come into contact with the part of the sidewall of the toilet upon which the device 10 is mounted. Further, while not specifically depicted in the figures, it is to be understood that the base 17 may also include one or more downwardly directed slits, holes, orifices or openings extending therethrough, such as slot openings (see 62, 64 of FIG. 9) or alternately one or more other orifices, e.g., circular, non-circular, elliptical, etc., which permit for the egress of a part of the largely aqueous lavatory treatment composition through the base 17 and into the toilet bowl.

Figure 2:
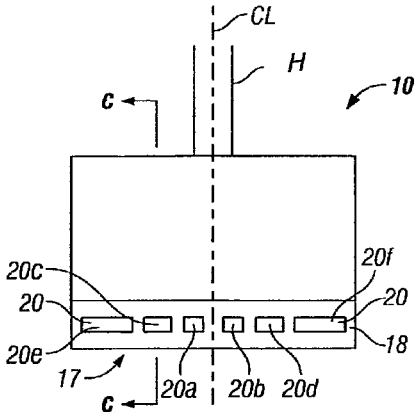

FIG. 2 depicts a front elevation view of the improved lavatory dispensing device 10 discussed with reference to FIG. 1. In this view, only a part of the hanger H is depicted. The positioning and dimensions of the openings 20 are now more evident from FIG. 2. As is seen thereon, the instant embodiment of the device 10 is provided with six separate openings, here individually referred to as 20*a*, 20*b*, 20*c*, 20*d*, 20*e*, and 20*f* but which may collectively referred to as the openings 20. As visible, the dimensions of openings 20*a* and 20*b* are identical, the dimensions of openings of 20*c* and 20*d*, and similarly the dimensions of openings 20*e* and 20*f* are also identical with respect to one another. Further visible is that the openings 20 are spaced apart with respect to one another, but in a linear arrangement which is essentially perpendicular to a centerline "CL" which may be used with reference to the device. Furthermore, it is seen that openings 20*a* and 20*b* are identical and equally distant from the center line but on opposite sides of the center line. Similarly openings 20*c* and 20*d* are identical and equally distant from the center line but on opposite sides of the center line, and that openings 20*e* and 20*f* are identical to each other and equally distant from the center line but on opposite sides of the center line. Thus, the placement of the individual openings 20 is seen to be symmetrical, with respect to the center line "CL". Thus the center line "CL" also defines a line or plane of symmetry for the placement of the individual openings 20. It is to be further noted that the cross-sectional areas of the individual openings differ from one another, namely in that these cross-sectional areas of openings 20*a* and 20*b* are lesser then the cross-sectional areas of openings 20*c* and 20*d*, which in turn are lesser than the cross-sectional areas of openings 20*e* and 20*f*. Such illustrates a preferred embodiment of the invention. While not wishing to be bound by theory, it is believed that the placement of the openings having the smallest cross-sectional area closest to the center line, and progressively placing openings of increasingly greater cross-sectional area further from the center line may improve the distance which an individual jet may traverse after being expelled from the device via its corresponding opening. Advantageously, the cross-sectional areas of openings 20*a* and 20*b* are at least 30% less, more preferably at least 40% less than the cross-sectional areas of openings 20*c* and 20*d*, which in turn are at least 30% less, more preferably at least 40% less than the cross-sectional areas of openings 20*e* and 20*f*. Such a configuration has been observed to provide both a very satisfactory distance of the individual jets of largely aqueous lavatory treatment composition exiting the device.

Figure 3:
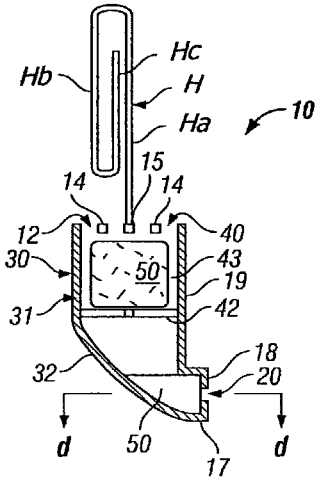

FIG. 3 is a cross-sectional view of the device 10 according to FIGS. 1 and 2, taken along the section indicated by line c-c. As is seen thereon, the hanger H is formed from three interconnected articulate segments, Ha, Hb and Hc which are depicted in a folded configuration. Is to be understood nonetheless, that they may be extended to form the extended configuration as illustrated for the hanger 20 of FIG. 1. Such a foldable form of a hanger H is particularly convenient and advantageous from a packaging standpoint. Further visible is the cross-sectional arrangement of the individual elements forming the device 10. The inlet 12 is spanned by inlet retainer means, here the grill 14. The device includes a front wall 19 and a back wall 30. The front wall 19 extends downwardly from the opening 12 where it meets the bottom front face 18; in this embodiment both the front to wall 19 and the bottom front face 18 are substantially planar. The back wall 30 extends downwardly from the opening 12 and includes a top section 31 which is substantially planar and spaced apart with respect to the front wall 19 and there between defines an interior cavity 40 within which a treatment composition 50, here in the form of a compressed cake or block, such as an excluded block, may be retained. The treatment composition 50 rests upon a support means 42, here a second grill. As is seen, the dimensions of the treatment composition 50 are such that a gap exists between the treatment composition 50 and at least one on the front wall 19 and/or back wall 30. In such a manner, any water, such as flush water, enters via the inlet 12 passes the grill 14 and passes around the exterior of the treatment composition 50 where he can dissolve a part thereof and/or entrain a part thereof, thereby forming a substantially aqueous, lavatory treatment composition which passes downwardly within the device 10. The downwardly flowing, lavatory treatment composition is diverted by the bottom section 32 of the back wall 30 which is seen here, is angled away from the top section 31 of the back wall 30. The diverted lavatory treatment composition flows downwardly, where it is divided into separate (volumetric) portions by one or more vanes 50. The vanes 50 extend upwardly from the base 17 and are rearward of the openings 20. The positioning of the vanes 50 and their relative orientation are discussed with reference to the following FIG. 4.

Figure 4:
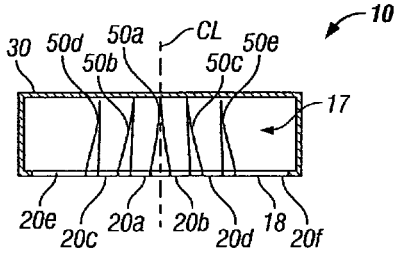

FIG. 4 is a cross-sectional view of a part of the dispensing device 10 along line d-d of FIG. 3, which is approximately at the mid-point of the individual openings 20*a*, 20*b*, 20*c*, 20*d*, 20*e* and 20*f*. As is seen thereon, five separate vanes, individually vanes 50*a*, 50*b*, 50*c*, 50*d* and 50*e* extend upwardly from the base 17 and are positioned such that each of their respective bases are between two adjacent openings 20*a*, 20*b*, 20*c*, 20*d*, 20*e*, and 20*f*. It is all seen that vanes are angled with respect to the bottom front face 18, which angled orientation may be used to provide a fan-like spray pattern of the individual jets of the largely aqueous lavatory treatment composition exiting via the respective openings 20 of the device 10. Vane 50*a* is coincident with and symmetrical with regard to a center line "CL", vanes 50*b* and 50*c* or symmetrical with the center line CL and equidistant therefrom, although on opposite sides of the center line CL, and similarly vanes 50*d* and 50*e* or symmetrical with the center line CL and equidistant therefrom, although on opposite sides of the center line CL. With regard to the figure, it is to be understood that the spaces between respective vanes 50 also define separate volumetric spaces or cavities into which the lavatory treatment composition flows from the upper parts of the device 10. According to the preferred embodiment depicted, the volumetric spaces supplying openings 20*a* and 20*b* are approximately equal, the volumetric spaces supplying openings 20*c* and 20*d* are approximately equal, and the volumetric spaces supplying openings 20*e* and 20*f* are approximately equal. Such an arrangement is believed to balance the output of the device 10, as it is believed at the maximum outlet pressure will occur at openings 20*a* and 20*b*, with relatively lesser pressures at the pair of openings 20*c* and 20*d*, and with still relatively lesser pressures at the pair of openings 20*e* and 20*f*. Such is believed to impart the fan-like spray pattern depicted upon FIG. 1. Also, it has been observed that the jets exiting the pair of openings 20*a* and 20*b* "leap" furthest away from the device 10.

Figure 4A:
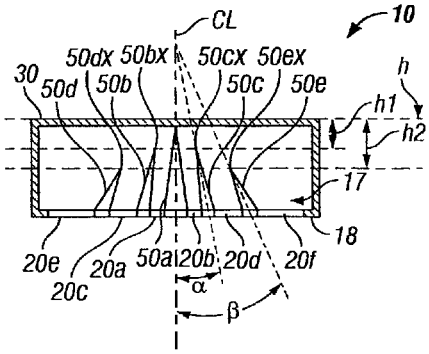

FIG. 4A is a cross-sectional view of an alternate embodiment of a part of the dispensing device 10 along line d-d of FIG. 3, which is approximately at the mid-point of the individual openings 20*a*, 20*b*, 20*c*, 20*d*, 20*e* and 20*f*. As is seen thereon, five separate vanes, individually vanes 50*a*, 50*b*, 50*c*, 50*d* and 50*e* extend upwardly from the base 17 and are positioned such that each of their respective bases are between two adjacent openings 20*a*, 20*b*, 20*c*, 20*d*, 20*e*, and 20*f*. It is all seen that vanes are angled with respect to the bottom front face 18, which angled orientation may be used to provide a fan-like spray pattern of the individual jets of the largely aqueous lavatory treatment composition exiting via the respective openings 20 of the device 10. Vane 50*a* is coincident with and symmetrical with regard to a center line "CL", vanes 50*b* and 50*c* or symmetrical with the center line CL and equidistant therefrom, although on opposite sides of the center line CL, and similarly vanes 50*d* and 50*e* or symmetrical with the center line CL and equidistant therefrom, although on opposite sides of the center line CL. It is to be further pointed out that the respective apex of each of vanes 50*b*, 50*c*, 50*d* and 50*e* do not extend to the back wall 30 unlike vane 50*a* which does. Rather, as can be seen from FIG. 4A, both the apicies 50*dx* and 50*ex* of respectively, vanes 50*d* and 50*e* extend in an angular direction with respect to the center line "CL" rearwardly towards the back wall 30 but does not extend sufficiently to actually contact the rear wall, but are spaced away from by a distance defined as a distance between lines "h2" which intercepts the apicies 50*dx* and 50*ex*, and the line "h" which is coincident with the back wall 30. Similarly, both the apicies 50*bx* and 50*cx* of respectively, vanes 50*b* and 50*c* extend in an angular direction with respect to the center line "CL" rearwardly towards the back wall 30 but does not extend sufficiently to actually contact the rear wall, but are spaced away from by a distance defined as a distance between lines "h1" which intercepts the apicies 50*bx* and 50*cx*, and the line "h" which is coincident with the back wall 30. Advantageously the distance h1 is less than that of the distance h2, and preferably h1 is less than ½ of the distance between the bottom front face 18 and the back wall 10 of the device 10, and preferably is less than ⅓, more preferably is less than ¼ of this distance. Advantageously the distance h2 is equal to that of h1, but preferably h2 is a more than ¼ but less than ⅞ of the distance between the bottom front face 18 and the back wall 30 of the device 10, but preferably is more than ⅓ but less than ⅞ of the distance, yet more preferably is ½ or more, but less than ⅞ of this distance. In especially preferred embodiments the distance h2 is not more than the distance h1, and particularly preferably is greater than h1, especially at least 1.1×h1, particularly preferably at least 1.25×h1, and most preferably is at least 1.5×h1. In this manner the height of vanes which extend to the left and right of the center line are of decreasing height, that that their respective apicies are of increasing distance from the back wall 30 as the vanes extend further away from the center line CL. The angle "α" between the vanes 50*b* and 50*c* are identical, albeit are on opposite sides of the center line CL and can be established by determining the angle between the center line CL and a line drawn between the mid-point of a base of a vane and its apex. In a somewhat similar fashion, the angle "β" between the vanes 50*d* and 50*e* are identical, albeit are on opposite sides of the center line CL. While the angles "α" and "β" may be the same or different, advantageously the angle "β" is greater than that of angle "α". Advantageously angle "α" may be from 0° to 65° of arc, preferably are between 2° and 45°, yet more preferably are between 5° and 40° of arc. Advantageously angle may be from 0° to 75° of arc, preferably are between 5° and 65°, yet more preferably are between 10° and 50° of arc. With regard to the figure, it is to be understood that the spaces between respective vanes 50 also define separate volumetric spaces or cavities into which the lavatory treatment composition flows from the upper parts of the device 10. According to this alternate preferred embodiment depicted, the arrangement of the vanes 50*a*, 50*b*, 50*c*, 50*d* and 50*e* may be used to provide a fan-like spray pattern such as depicted upon FIG. 1. F A second embodiment of the lavatory dispensing device 10 according to the invention is depicted on FIGS. 5 and 6. FIG. 5 illustrates a front elevation view of the second embodiment of the device 10 according to the invention, which but for the following is substantially similar to the first embodiment of the invention described with reference to the prior figures. In the instant embodiment, the openings 20*a*, 20*b*, 20*c*, 20*d*, 20*e* and 20*f* are circular in cross-section, rather than rectangular in cross-section. As is visible from FIG. 5, the dimensions of openings 20*a* and 20*b* are identical, the dimensions of openings of 20*c* and 20*d*, and similarly identical and the dimensions of openings 20*e* and 20*f* are also identical with respect to one another. Further visible is that the openings 20 are spaced apart with respect to one another, but in a linear arrangement which is essentially perpendicular to a centerline "CL" which may be used with reference to the device. Furthermore, it is seen that openings 20*a* and 20*b* are identical and equally distant from the center line but on opposite sides of the center line. Similarly openings 20*c* and 20*d* are identical and equally distant from the center line but on opposite sides of the center line, and that openings 20*e* and 20*f* are identical to each other and equally distant from the center line but on opposite sides of the center line. Thus, the placement of the individual openings 20 is seen to be symmetrical, with respect to the center line "CL". Thus the center line "CL" also defines a line or plane of symmetry for the placement of the individual openings 20. It is to be further noted that the cross-sectional areas of the individual openings differ from one another, namely in that these cross-sectional areas of openings 20*a* and 20*b* are lesser then the cross-sectional areas of openings 20*c* and 20*d*, which in turn are lesser than the cross-sectional areas of openings 20*e* and 20*f*.

FIG. 6 illustrates a top view of the second embodiment of the device 10. As can be seen here from, the shape of the bottom front face 18 is arcuate, while the front wall 19 is essentially planar. Six individual jets "j" of the largely aqueous, lavatory treatment composition exit the respective openings passing through the bottom front face 18 and define a fan-like spray pattern which is broad and angled with respect to the center line "CL". One mode of measuring the angle of the fan-like spray pattern is to measure the angles "z" between center line CL of the device, and the jets "j" furthest from the center line CL. Such is depicted in FIG. 6.

Figure 7:
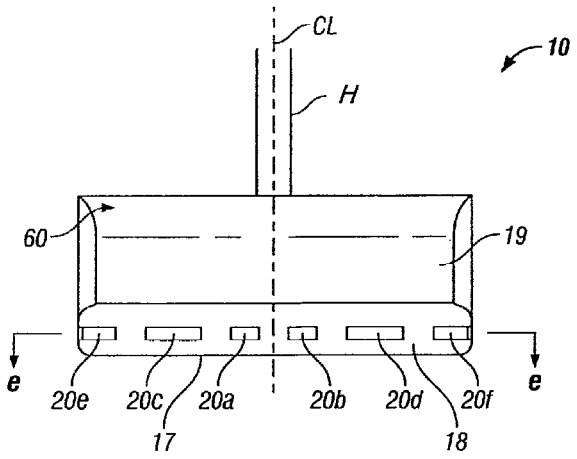

FIGS. 7-12 depict a third embodiment of the device 10 according to the present invention. FIG. 7 and depicts a front elevation view of a third embodiment of an improved lavatory dispensing device 10 according to the invention. As illustrated thereon, the third embodiment includes a forwardly extending lip section 60 at the upper part of the front wall 19. Additionally, it is to be noted in that the bottom face wall 18 also includes six separate openings, here individually referred to as 20*a*, 20*b*, 20*c*, 20*d*, 20*e*, and 20*f* but collectively referred to as openings 20. Whereas 20*a*, 20*b*., 20*c*, 20*d*., are directed only through the front of the bottom front face 18 of the device, openings 20*e* and 20*f* extend through both the front of the bottom front face 18 as well as through a part of the sides of the device 10. Such provides for a broader fan-like spray pattern due to the more lateral direction of the jets exiting openings 20*e* and 20*f*. Further visible is that the openings 20 are spaced apart with respect to one another, but in a linear arrangement which is essentially perpendicular to a centerline "CL" which may be used with reference to the device. As with the first embodiment discussed previously, openings 20*a* and 20*b* are identical and equidistant from the center line but on opposite sides of the center line. Similarly openings 20*c* and 20*d* are identical and equidistant from the center line but on opposite sides of the center line, and that openings 20*e* and 20*f* are identical to each other and equidistant from the center line but on opposite sides of the center line. Thus, the placement of the individual openings 20 is symmetrical with respect to the center line "CL". Thus the center line "CL" also defines a line or plane of symmetry for the placement of the individual openings 20. It is to be further noted that the cross-sectional areas of the individual openings differ from one another, namely in that these cross-sectional areas of openings 20*a* and 20*b* are lesser then the cross-sectional areas of openings 20*c* and 20*d*, which in turn may be equal to, but as depicted here are lesser than the cross-sectional areas of openings 20*e* and 20*f*.

Figure 8:
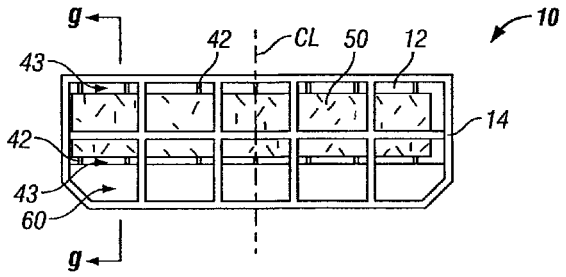

FIG. 8 illustrates a top view of the device 10 discussed with reference to FIG. 7. In this figure, the attachment of the hanger H has been omitted for the sake of clarity. The forwardly extending lip section 60 extends downwardly into the interior of the device 10. The addition of the forwardly extending lip section 60 is provided in order to capture a greater volume of the available flush water dispensed by the lavatory appliance, especially a toilet into the interior of the device 10 where it can come into contact with the depicted block of the treatment composition 50 and thereby form a largely aqueous lavatory treatment composition which can subsequently exit the device 10.

Figure 9:
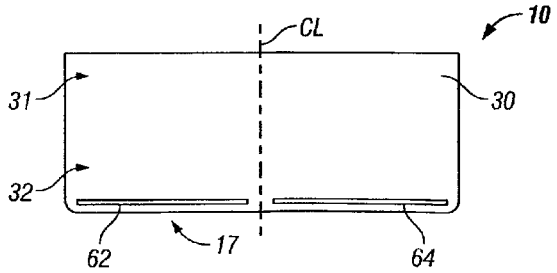

FIG. 9 illustrates an elevation view of the rear of the device 10 including the top section 31 and bottom section 32 of the back wall 30. Near the base 17 and extending through a part of the bottom section 32 are a pair of slot openings 62, 64 which permit for the egress of a part of the largely aqueous lavatory treatment composition through the bottom part of 32 of the back wall 30. An advantage of including such slot opening 62, 64 are that it provides for a quantity of the lavatory treatment composition formed within the interior of the device tend to come into contact with the part of the sidewall 102 of the toilet 100 upon which the device 10 is mounted. Thus, according to the depicted embodiment, a major quantity of the lavatory treatment composition would issue out of the openings 20, while a minor amount may issue out through one or more of the slot opening 62, 64.

Figure 10:
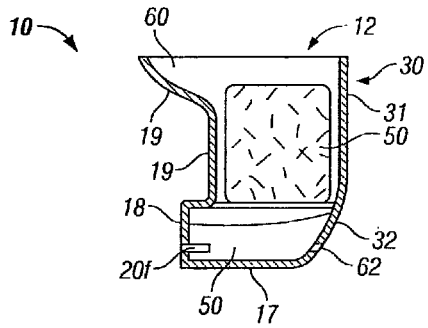

FIG. 10 illustrates a cross-sectional view of the third embodiment of the device 10 taken along line g-g of FIG. 8. Depicted in the figure are the relative placements of the various elements previously described, including the forwardly extending lip section 60. In this view, both the grill 14 and the hanger H are also omitted for the sake of clarity.

Figure 11:
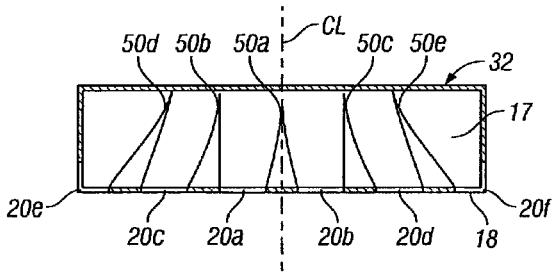

FIG. 11 illustrates a cross-sectional view of the third embodiment of the device 10 taken along line e-e of FIG. 7. Depicted in the figure are the relative placements of the various elements including the positioning of the vanes 50 (individually 50*a*, 50*b*, 50*c*, 50*d* and 50*e*) extending upwardly from the base 17 and their individual positioning with respects to one or more of the openings 20. The arrangement of, and the operation of the vanes 50 with respect to the individual openings 20 is substantially similar to that described and discussed with reference to FIG. 4. Alternately, while not illustrated specifically, it is to be understood that the positioning of the vanes 50 (individually 50*a*, 50*b*, 50*c*, 50*d* and 50*e*) extending upwardly from the base 17 and their individual positioning with respect to one or more of the openings 20 may be as depicted with reference to FIG. 4A.

Figure 12:
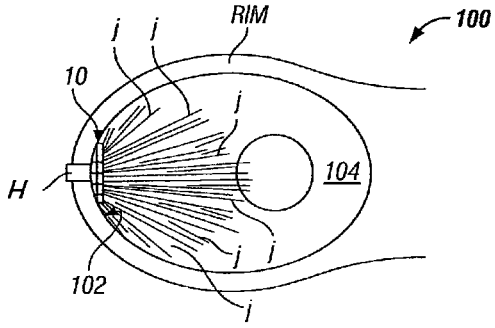

FIG. 12 illustrates the operation of the dispensing device 10 mounted along a part of the rim of a toilet 100. Dispensing device 10 is suspended via its hook 20 and adjacent to a portion of the sidewall 102 of the toilet 100. The direction of the jets "j" exiting device 10 are directed towards the opposite sidewall 104 of the toilet 100. As is visible, the configuration of the jets is in a fan-like spray pattern and, the centermost jets travel the furthest distance from the device 10. As is further seen from the figure, the jets exiting the device 10 via the openings of most distant from the centerline of the device, namely openings 20*e* and 20*f* (not depicted) flow outward in a sidewise lateral direction. Also not specifically depicted, but understood as being present, are the two slot like openings 62 and 64 which are to be understood as delivering a quantity of the largely aqueous, lavatory treatment composition to the sidewall portion 102 of the toilet 100.

With regard to the foregoing embodiments described herein it is to be understood that part or elements of one embodiment can be substituted for related part or elements in different embodiments.

It is to be understood that a lavatory dispensing device as disclosed herein may also have a different geometry, configuration or and appearance than the embodiments described in the Figures and still be considered to fall within the scope of the invention.

In a further aspect of the present invention there is also provided a process for delivering a treatment composition to a sanitary appliance, especially preferably, to the interior of a toilet bowl. This process includes the steps of: providing a lavatory dispensing device as described hereinabove to the interior of the bowl of a lavatory appliance, especially to the interior of a toilet bowl and, periodically supplying water through the lavatory treatment device in order to form and deliver one or more streams or jets of a largely aqueous lavatory treatment composition in a transverse direction and away from the portion of the sidewall of the lavatory treatment device, e.g., toilet within which the device is mounted, which said composition is used to treat the interior of the bowl of the lavatory appliance, preferably the interior of a toilet bowl.

The foregoing process may be practiced to provide a cleaning treatment and/or a sanitizing or disinfecting treatment to the toilet bowl or a part thereof, or alternately to a part of a sanitary appliance.

While the invention is susceptible of various modifications and alternative forms, it is to be understood that specific embodiments thereof have been shown by way of example in the drawings which are not intended to limit the invention to the particular forms disclosed; on the contrary the intention is to cover all modifications, equivalents and alternatives falling within the scope and spirit of the invention as expressed in the appended claims.

The invention claimed is:

1. A lavatory dispensing device comprising:

an inlet adapted to be suspended beneath the rim of a toilet bowl and adapted to receive water exiting from beneath the rim wherein the device is positioned within the interior of a toilet bowl and adjacent to a sidewall of the toilet bowl;

an interior for containing a treatment composition;

a base;

a front face having a plurality of openings passing therethrough;

wherein, in use, water supplied from the rim of the toilet bowl entering the inlet is directed through the interior, forms a lavatory treatment composition within the interior, and the lavatory treatment composition exits the device as a one or more jets of the lavatory treatment composition which are directionally sprayed in the direction of an opposing sidewall of the toilet bowl and, wherein the plurality of openings are such that openings having the smallest cross-sectional area are closer to a center line of the device, than openings which are relatively more distant from the center line of the device.

2. A lavatory dispensing device according to claim 1 wherein the lavatory dispensing device further comprises one or more flow directing vanes within the interior of the container which said vanes divide the volume of the aqueous lavatory treatment composition downstream of the treatment composition and direct these separate volumes of the aqueous lavatory treatment compositions to individual openings through which the aqueous lavatory treatment composition exits the device.

3. A process for delivering a treatment composition to the interior of a toilet bowl which process comprises the steps of:

providing a lavatory dispensing device according to claim 1 to the interior of the toilet bowl and, periodically supplying flush water through the lavatory dispensing device to form and deliver one or more streams or jets of a largely aqueous lavatory treatment composition in a transverse direction and away from the portion of the sidewall of the toilet within which the device is mounted, which said composition is used to treat the interior of the toilet bowl.

4. A lavatory dispensing device according to claim 1 wherein the treatment composition in the form of a tablet, cake, block or gel.

5. A lavatory dispensing device according to claim 1, wherein the device includes an inlet through which flush water from the toilet bowl enters an interior cavity of the device in which is present the treatment composition in the form of a tablet, cake, block or gel which is supported by a grill.

6. A lavatory dispensing device according to claim 1 wherein the device includes a front wall, and a back wall, the back wall having a top section and a bottom section which is angled away from the top section.

7. A lavatory dispensing device according to claim 1 which further comprises a hanger.

8. A lavatory dispensing device according to claim 1, wherein at least two of the openings have different dimensions.

9. A lavatory dispensing device according to claim 1, wherein the difference between two of the cross-sectional areas of the openings present in the device is at least 30%.

10. A lavatory dispensing device according to claim 9, wherein the difference between two cross-sectional areas of the openings present in the device is at least 40%.

11. A lavatory dispensing device according to claim 2, wherein the vanes extend upwardly from the base within the interior of the device.

12. A lavatory dispensing device according to claim 11, wherein the vanes are angled with respect to the front face of the device.

13. A lavatory dispensing device according to claim 12, wherein one or more vanes have bases which are between two adjacent openings of the device.

14. A lavatory dispensing device according to claim 6, wherein the back wall comprises at least one slot opening.

* * * * *